US006101692A

United States Patent [19]

Linville et al.

[11] Patent Number: 6,101,692

[45] **Date of Patent: *Aug. 15, 2000**

[54] CASKET WITH CONTIGUOUS, INTEGRAL HARDWARE BOSSES

[75] Inventors: John E. Linville, Louisville, Ky.; Dennis C. Laphan, Cincinnati, Ohio; Anthony S. Casablanca, Batesville, Ind.

[73] Assignee: Batesville Services, Inc., Batesville, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/977,103

[22] Filed: Nov. 24, 1997

Related U.S. Application Data

[63] Continuation-in-part of application No. 08/620,113, Mar. 28, 1996, Pat. No. 5,689,869.

[51] Int. Cl.[7] ..... A61G 17/00

[52] U.S. Cl. ..... 27/2; 27/27

[58] Field of Search ..... 27/2, 1, 3, 4, 5, 27/6, 27, 35; 220/770, 772; 16/112, 114 R

[56] References Cited

U.S. PATENT DOCUMENTS

| | | | |
|---|---|---|---|
| 189,449 | 4/1877 | Gartland | 27/2 |
| 189,809 | 4/1877 | Spencer | 27/2 |
| 2,494,473 | 1/1950 | Dowling | 27/7 |
| 2,697,266 | 12/1954 | Raper . | |
| 3,204,286 | 9/1965 | Hillenbrand . | |
| 3,490,114 | 1/1970 | Connelly et al. . | |
| 3,657,764 | 4/1972 | Relly et al. . | |
| 3,681,820 | 8/1972 | Jalbert . | |
| 3,823,447 | 7/1974 | Johnson . | |
| 3,997,949 | 12/1976 | Waltz | 27/2 |
| 4,044,435 | 8/1977 | Acton . | |
| 4,146,948 | 4/1979 | Royce et al. . | |
| 4,237,590 | 12/1980 | Work . | |
| 4,320,562 | 3/1982 | Kelley . | |
| 4,337,556 | 7/1982 | Winburn et al. . | |
| 4,523,358 | 6/1985 | Semon . | |
| 4,571,790 | 2/1986 | James, III . | |
| 4,930,197 | 6/1990 | McClive . | |
| 5,008,990 | 4/1991 | Craft . | |
| 5,144,727 | 9/1992 | Craft . | |
| 5,377,395 | 1/1995 | Maier et al. . | |
| 5,463,800 | 11/1995 | Rojdev . | |
| 5,519,923 | 5/1996 | Rojdev et al. . | |
| 5,531,000 | 7/1996 | Biondo . | |
| 5,555,612 | 9/1996 | Biondo . | |
| 5,561,892 | 10/1996 | Biondo . | |
| 5,604,965 | 2/1997 | Shaw et al. . | |
| 5,689,869 | 11/1997 | Linville et al. | 27/2 |

*Primary Examiner*—Kien T. Nguyen
*Attorney, Agent, or Firm*—Barnes & Thornburg

[57] ABSTRACT

A casket includes a casket shell and a handle bar. The casket includes a side wall with a plurality of external hardware bosses formed integrally and contiguously with the side wall and protruding outwardly therefrom. Each hardware boss is generally hollow and formed to define an interior region that is at least partially bounded by a respective protruded wall offset outwardly from the side wall. A respective first transition wall integrally connects the side wall and respective protruded wall, and a respective second transition wall spaced from the first transition wall and integrally connects the side wall and respective protruded wall, each of the first and second transition walls being formed to include a handle-receiving void, and a handle bar extending through the voids.

24 Claims, 12 Drawing Sheets

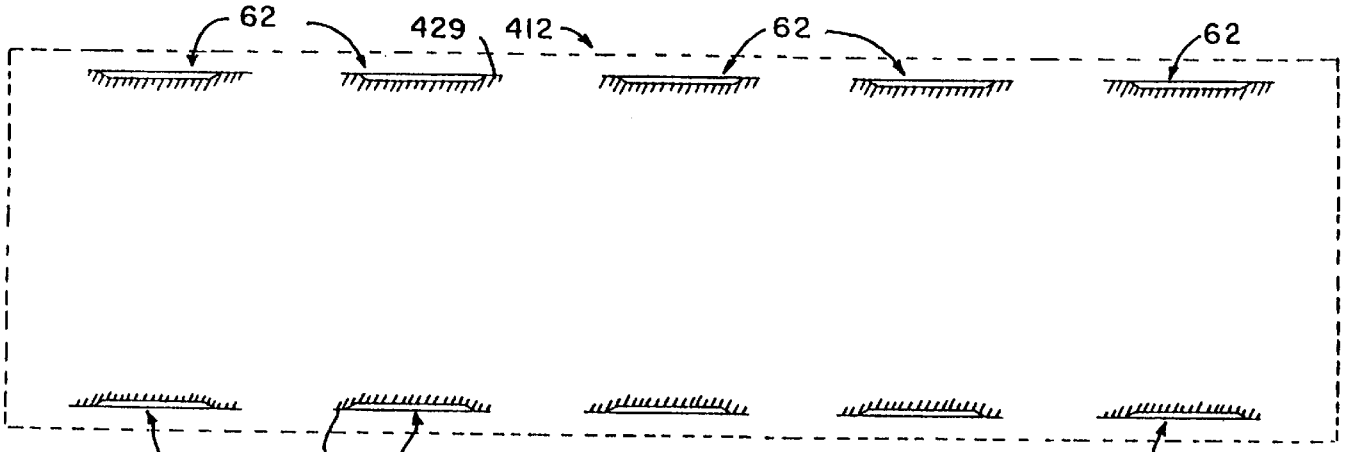
FIG. 9
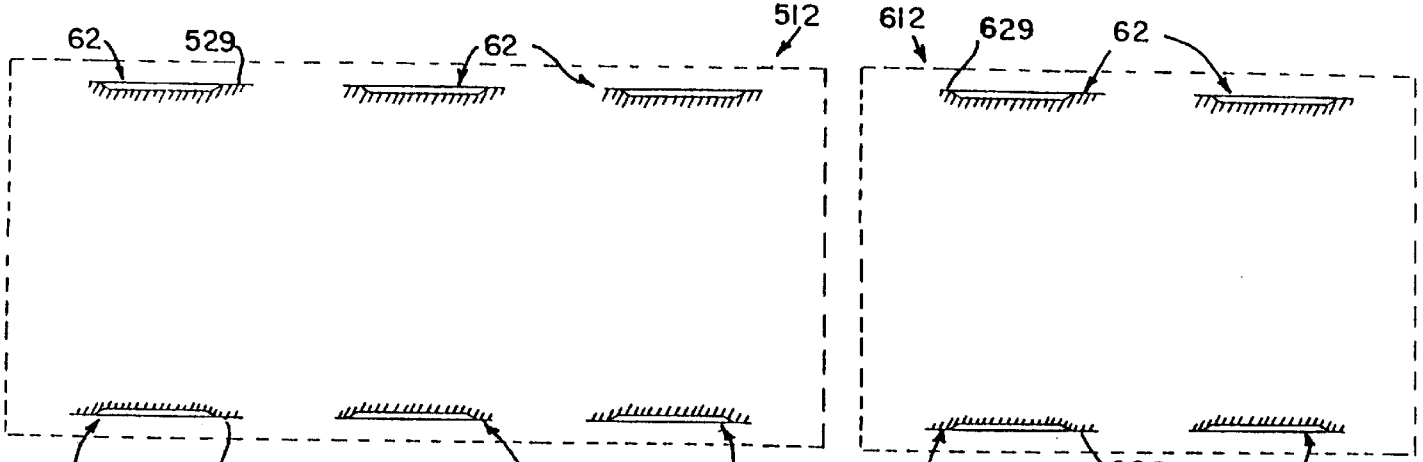
FIG. 10
FIG. 11

CASKET WITH CONTIGUOUS, INTEGRAL HARDWARE BOSSES

RELATED APPLICATIONS

This application is a continuation-in-part of application Ser. No. 08/620,113, filed Mar. 28, 1996, and issued as U.S. Pat. No. 5,689,869 on Nov. 25, 1997.

BACKGROUND AND SUMMARY OF THE INVENTION

The present invention relates to a casket, and particularly, to hardware bosses for mounting a handle to a casket shell of the casket. More particularly, the present invention relates to a casket with integral, contiguous hardware bosses that are formed in side walls of the casket shell of the casket.

Many caskets are provided with "swing bar type" handles or handles mounted on "swing hardware." Conventional swing hardware includes one or more bosses, a handle swingably mounted to the bosses, and bolts or screws for attaching the bosses to the casket shell. The handle swings outwardly from a non-operative position to an outward operative position relative to the bosses and casket shell when the casket is to be carried. See, for example, U.S. Pat. Nos. 3,204,286 to Hillenbrand and 3,657,764 to Relly et al., both of which are assigned to the assignee of the present invention. Swing hardware permits the person carrying the casket to grasp the handle without engaging the casket shell while also permitting the handle and associated hardware to fit within a limited envelope of space surrounding the casket during storage, during transport on shipping pallets or in shipping containers, and during use when the casket is placed into a mausoleum or a burial vault.

Caskets having handles fixed relative to the casket shell are also known in the art. For example, U.S. Pat. Nos. 4,337,556 to Winburn et al. and 4,312,104 to Baker et al., both of which are assigned to the assignee of the present invention, each show caskets having handles that are fixed relative to the shell. In addition, U.S. Pat. Nos. 4,930,197 to McClive; 3,681,820 to Jalbert; 2,494,473 to Dowling; 2,392,298 to Thommen; 4,730,370 to Elder; 4,773,134 to Kay; 4,967,455 to Elder; 1,508,745 to Cassel; 2,655,712 to Glassner; 1,660,019 to Tazza; 1,730,666 to Listing; 2,974,390 to Nelson; 3,406,229 to Cenegy; and 4,829,639 to Woedl et al. all disclose caskets having handles that are fixed relative to the casket shell. Conventional fixed handles include one or more bosses, a grip bar fixed to the bosses, and bolts or screws for attaching the bosses to the casket shell. See, for example, U.S. Pat. Nos. 4,930,197 to McClive and 3,490,114 to Connelly et al.

What is needed is a casket having a casket shell with hardware bosses formed integrally and contiguously with a side wall thereof and adapted to allow either a single-piece or multiple-piece handle to be mounted to the casket shell without the use of bolts or screws. The integral hardware bosses should allow mounting of either fixed handles or swingable handles to the casket shell. Casket manufacturers will appreciate that forming hardware bosses integrally with the casket shell reduces the number of separate components, such as bolts and screws, that must be handled during the construction of the casket.

According to the present invention, a casket includes a casket shell having a side wall with an outwardly facing side surface. The casket shell further includes a recessed wall offset inwardly from the side wall, a first transition wall integrally connecting the side and recessed walls, and a second transition wall spaced apart from the first transition wall and integrally connecting the side and recessed walls. The first and second transition walls cooperate with the recessed wall to define a cavity in the side wall to provide the casket with an internal hardware boss. The first and second transition walls are each formed to include a handle-receiving void. The casket further includes a handle having a first end received in the handle-receiving void of the first transition wall, a second end received in the handle-receiving void of the second transition wall, and a gripping portion between the first and second ends.

In some preferred embodiments, the handle is a swing-type handle that couples to the first and second transition walls for pivoting movement between a nonoperative position in which the gripping portion of the handle is positioned to lie inside the cavity and an outward position in which the gripping portion of the handle is positioned to lie outside the cavity. In other preferred embodiments, the handle is a straight bar extending between the first and second transition walls inside the cavity. In one embodiment of the present invention, the handle-receiving voids are apertures formed in the first and second transition walls and portions of the handle are received in the apertures. In another embodiment of the present invention, the handle-receiving voids are grooves formed in the first and second transition walls and end portions of the handle are received in the respective grooves.

Also according to the present invention, a casket includes a casket shell having a side wall with an outwardly facing side surface. The casket shell further includes a protruded wall offset outwardly from the side wall, a first transition wall integrally connecting the side wall and the protruded wall, and a second transition wall spaced apart from the first transition wall and integrally connecting the side wall and the protruded wall. The first and second transition walls cooperate with the protruded wall to define a protrusion in the side panel to provide the casket with an external hardware boss. The first and second transition walls each are formed to include a handle-receiving void. The casket further includes a handle having a portion received in at least one of the handle-receiving voids of the first and second transition walls. The handle includes a portion outside the handle-receiving void that can be gripped for carrying the casket.

In preferred embodiments, each of the handle-receiving voids of the external hardware boss can be either an aperture through which the handle extends, a groove in which an end portion of the handle is received, or a slot in each of the first and second transition walls. If the external hardware boss is provided with slots in the first and second transition walls, the external hardware boss will be provided with an opening that allows insertion of the handle into the slots. In addition, the boss can include material that extends between the first and second transition walls and that conforms to the shape of the slots to provide a channel extending through the hardware boss.

According to the present invention, a casket includes a casket shell having a longitudinal side wall formed to include a channel. The casket further includes a handle having an arm and a grip bar. The arm includes an end portion received in the channel to mount the handle to the casket shell. The channel has a cross section that prevents the handle from being moved transversely away from the side wall.

In a preferred embodiment, the channel has a female dove-tail shaped cross section and the end portion of the arm received in the channel has a male dove-tail shaped cross section. In addition, the casket includes one or more filler plugs that are inserted into the channel adjacent to the handle. The filler plugs include outer surfaces that are configured to be either flush with the side wall of the casket shell in which the channel is formed or to extend beyond the side wall of the casket shell. In one embodiment, the filler plugs include a piece of decorative molding and resilient fingers coupled to the piece of decorative molding. The resilient fingers snap into the channel to mount the piece of decorative molding to the casket shell.

In another embodiment of the present invention, the side wall is made of a sheet of material having an outer surface and an inner surface. The channel is formed in a portion of the sheet of material so as to provide the casket shell with a support ledge in an interior region of the casket shell. Another casket element, such as a mattress frame, can be supported in the interior region by the support ledge in spaced-apart relation with a bottom wall of the casket shell.

According to the present invention, a casket includes a casket shell having a longitudinal side wall formed to include a rail. The casket further includes a handle including an arm and a grip bar. The arm includes an end portion mounted on the rail. The rail has a cross section that prevents the handle from being moved transversely away from the side wall.

In a preferred embodiment, the rail has a male dove-tail shaped cross section and the end portion of the arm mounted on the rail has a female dove-tail shaped cross section. In such an embodiment, the handle may include a latch pivotably coupled to the arm for movement between a releasing position in which the latch is spaced apart from the rail to allow the handle to slide along the rail and a locking position in which the latch engages the rail to prevent the handle from sliding along the rail.

Thus, the integral hardware bosses of the present invention can be either external bosses that project away from the casket shell or internal bosses that are recessed into the casket shell. In addition, the integral hardware bosses of the present invention can be either rails or channels formed in the side walls of the casket shell. In each case, handles for carrying the casket are coupled to the hardware bosses that are formed integrally and contiguously with a side wall of the casket shell.

The handles mounted to the contiguous, integral hardware bosses of the present invention can include fixed handles and handles that swing relative to the hardware bosses. If handles that swing relative to the casket shell are provided, the casket shell in accordance with the present invention can accommodate the handle, and any hardware associated with the handle, within the internal hardware boss recessed into the casket shell. The handle and the swing hardware may be mounted so that the handle is received by the recessed portion and is flush with a generally vertical plane defined by the outer portion of the side wall when the handle is in the downward non-operative position and swings outwardly to the operative position when the casket is carried. Mounting the handle and swing hardware within the internal hardware boss provides for an efficient use of space allowing the size of the casket shell to be maximized while still fitting within the limited envelope of space surrounding the casket. According to the present invention, handles that swing relative to the casket shell can also be mounted to casket shells having external hardware bosses, channels, or rails formed in the side walls thereof.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF DRAWINGS

The detailed description particularly refers to the accompanying figures in which:

FIG. 9 is a diagrammatic view similar to FIG. 2 showing a casket shell for an over-sized casket having side panels that are each formed to include five recessed portions;

FIG. 10 is a diagrammatic view similar to FIG. 9 showing a casket shell for an under-sized casket having side panels that are each formed to include three recessed portions;

FIG. 11 is a diagrammatic view similar to FIG. 10 showing a casket shell for an under-sized casket having side panels that are each formed to include two recessed portions.

DETAILED DESCRIPTION OF THE DRAWINGS

Figure 1:
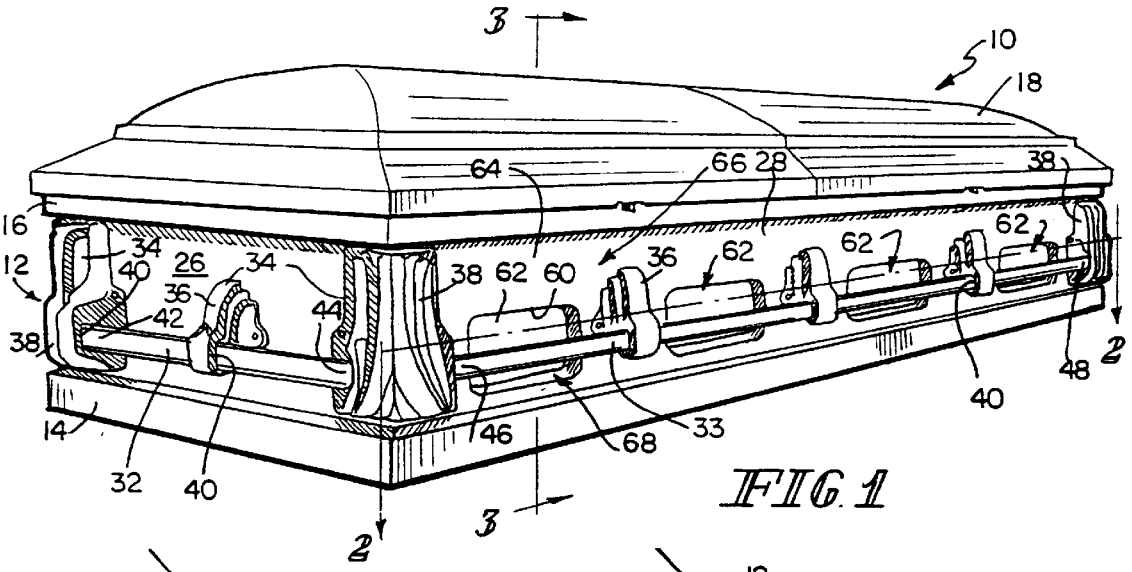
FIG. 1 is a perspective view of a casket in accordance with the present invention showing a side panel of the casket shell having a side surface formed to include a plurality of recessed portions and a side bar fixed to the casket shell side panel and positioned to lie in front of the recessed portions.
Figure 3:
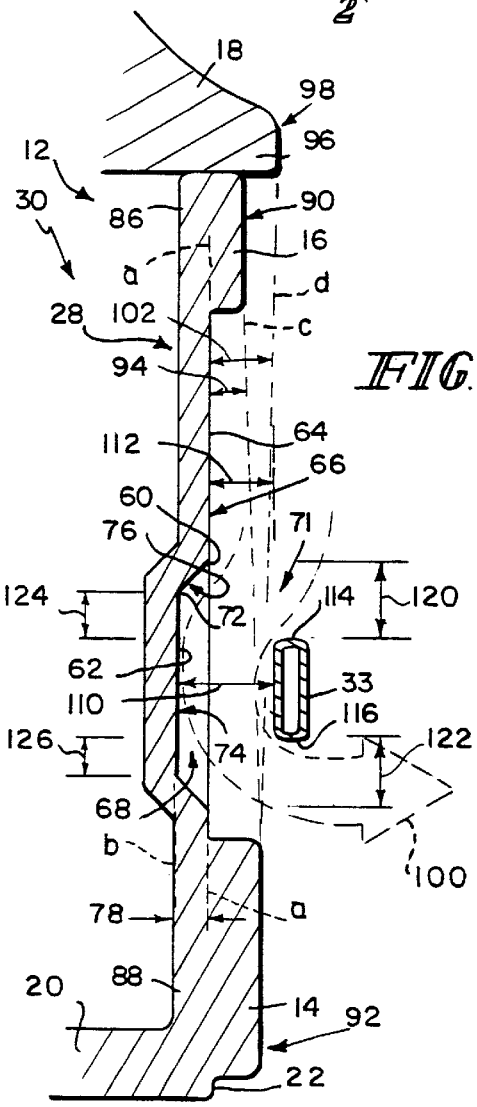
FIG. 3 is a dead sectional view taken along line 3—3 of FIG. 1 showing the shape of the side surface of the side panel adjacent to one of the recessed portions and the position of the side bar spaced apart from and in front of the recessed portion by a distance of at least a "grasping distance" that is sufficient to allow a pallbearer or other person carrying the casket shell to grasp the bar without engaging the side surface of the casket side panel.
Figure 4:
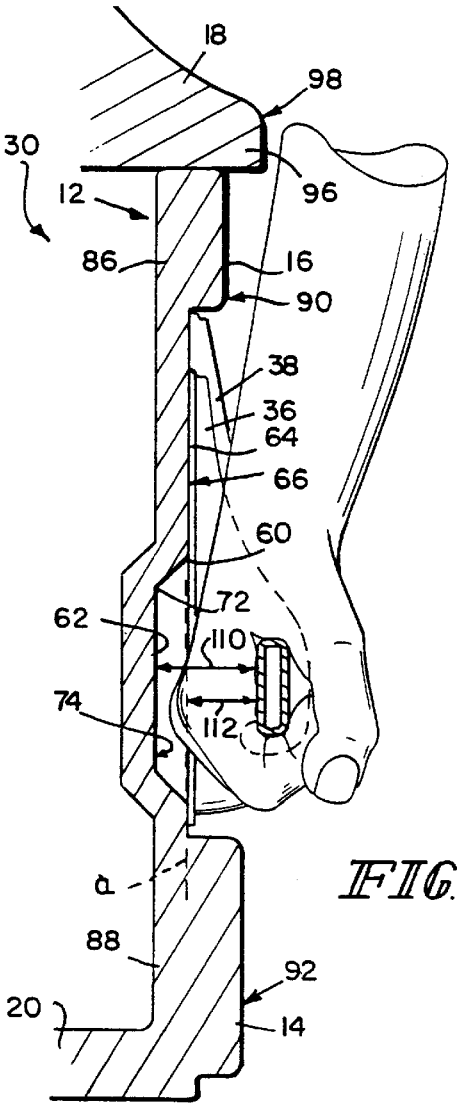
FIG. 4 is a view similar to FIG. 3 showing a hand and arm of a pallbearer or other person grasping the bar while carrying the casket shell, the knuckles of the person grasping the bar being spaced apart from the side surface of the casket side panel.

An illustrative casket 10 in accordance with the present invention includes a casket shell 12 formed to include a base 14 and an upper rim 16 as shown in FIGS. 1, 3, and 4. A lid 18 is attached to rim 16 by conventional hinging mechanisms (not shown) and is movable between a closed position, shown in FIG. 1, and an open position having lid 18 away from rim 16 to display the contents of casket shell 12.

Casket shell 12 includes an elongated bottom 20 having an elongated first side edge 22, an elongated second side edge (not shown) spaced apart from first side edge 22, a head end edge 24, and a foot end edge (not shown) that is longitudinally spaced apart from head end edge 24. A head end panel 26 is attached to head end edge 24 and extends upwardly therefrom, a foot end panel 27 is attached to the foot end edge and extends upwardly therefrom, a first side panel 28 is attached to the first side edge and extends upwardly therefrom, and a second side panel 29 is attached to the second side edge and extends upwardly therefrom. First side panel 28 and second side panel 29 cooperate with bottom 20, head end panel 26, and foot end panel 27 to define an interior region 30 of casket shell 12. Preferably, first side panel 28 and second side panel 29 are of unitary construction and can be formed by stamping side panels 28, 29 from a sheet of material, molding side panels 28, 29, or by any other suitable forming process without exceeding the scope of the invention as presently perceived.

In the illustrative and preferred embodiment of casket shell 12, foot end panel 27 is substantially similar to head end panel 26 and second side panel 29 is substantially similar to first side panel 28. The description herein related to head end panel 26 is thus descriptive of foot end panel 27 and the description herein related to first side panel 28 is descriptive of second side panel 29. Therefore, unless otherwise noted, the description below of head end panel 26 will also apply to foot end panel 27 and the description below of first side panel 28 will also apply to second side panel 29.

Bars 32, 33 are connected and fixed relative to casket shell 12 as shown in FIG. 1. Bosses 34 are fixed to head end panel 26 and first side panel 28 and include side bosses 36 projecting outwardly from panels 26, 28 of casket shell 12 and corner bosses 38 projecting outwardly from the corners of casket shell 12. Bosses 34 are formed to include openings 40 receiving bars 32, 33 and fixing bars 32, 33 to casket shell 12. Bosses 34 are preferably of unitary construction and are configured to hold bars 32, 33 in a fixed position relative to panels 26, 28 of casket shell 12. If desired, bosses 34 can be provided with an ornamental design to enhance the aesthetic appearance of casket 10.

Bars 32, 33 preferably include a pair of end bars 32, one end bar 32 extending along head end panel 26 and the other end bar 32 extending along foot end panel 27, and a pair of side bars 33, one side bar 33 extending along first side panel 28 and the other side bar 33 extending along second side panel 29. In preferred embodiments, each end bar 32 includes a first end 42 fixed to one corner boss 38 and a second end 44 fixed to another corner boss 38, bar 32 extending therebetween through an opening 40 formed in side boss 36 that is positioned between the two corner bosses 38 as shown in FIG. 1. Likewise, side bar 33 has a first end 46 fixed to one corner boss 38 and a second end 48 fixed to another corner boss 38, side bar 33 extending therebetween through openings 40 formed in three side bosses 36 positioned to lie between corner bosses 38.

Although the preferred bars 32, 33 are unitary bars extending between corner bosses 38, bars 32, 33 can also be comprised of bar sections each of which terminates within a boss 34. In this alternative configuration, the illustrative casket shell shown in FIG. 1 would include an end bar having two separate end bar sections, each end bar section being fixed to one corner boss 38 and one side boss 36. In addition, in this alternative configuration, the illustrative casket shell would include a side bar having four separate side bar sections, each side bar section being fixed to two bosses 34. It is therefore within the scope of the invention as presently perceived to provide bars 32, 33 of unitary construction and to provide bars 32, 33 comprised of a plurality of separate bar sections.

Each of first and second side panels 28, 29 is additionally formed to include an outwardly facing side surface 66 having a plurality of longitudinally spaced-apart edges 60. Each edge 60 defines a recessed portion 62 of side surface 66 that is recessed inwardly from an outer portion 64 of side surface 66. Each recessed portion 62 defines a hand-grip cavity 68 as shown in FIGS. 1–5.

Figure 2:
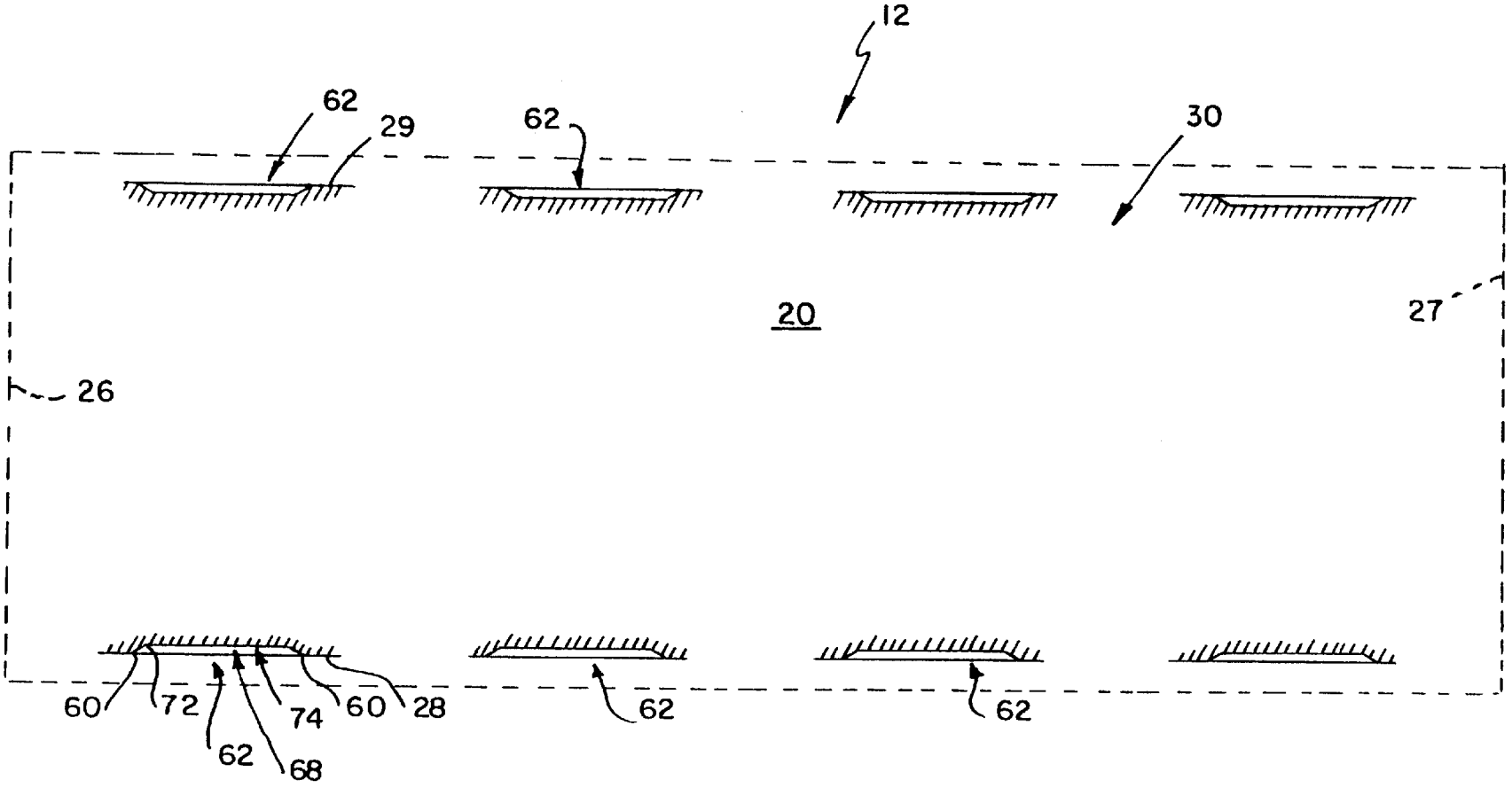
FIG. 2 is a diagrammatic sectional view taken along line 2—2 of the casket shell of FIG. 1 showing the plurality of recessed portions positioned on both the first and second side panels of the casket shell.

Side bar 33 includes a plurality of hand grips 70 described below with reference to FIG. 5 and each hand-grip cavity 68 is positioned to lie behind one of the hand grips 70 of side bar 33. This positioning of recessed portions 62 allows recessed portions 62 to operate as "targets" indicating where pallbearers or others carrying casket shell 12 (hereinafter "pallbearers") should be positioned to be properly spaced-apart and distributed along side panels 28, 29 of casket shell 12 when carrying casket 10 as shown in FIG. 2.

Each recessed portion 62 of illustrative and preferred casket shell 12 is preferably substantially similar to each other recessed portion 62 formed in side surface 66. The description below of one of recessed portions 62, particularly with reference to FIGS. 3–5, is descriptive of each recessed portion 62, and the description below of preferred recessed portion 62 should be taken as a description of each recessed portion 62 of illustrative and preferred side surface 66 of casket shell 12.

Edge 60 of side surface 66 of casket shell 12 is an outer edge of recessed portion 62 as shown best in FIGS. 2–5. Recessed portion 62 also preferably includes an inner edge 72 defining a generally planar surface 74 that preferably also defines an innermost portion of recessed portion 62 as shown best in FIGS. 3 and 4. If desired, recessed portion 62 and particularly planar surface 74 can be provided with one or more appliques (not shown) or other ornamentation to enhance the aesthetic appearance of casket 10.

A transition surface 76 is positioned to lie between outer edge 60 and inner edge 72. Although illustrative transition surface 76 is shown to incline gradually inwardly from outer edge 60 to inner edge 72 defining a ramped portion therebetween, it is within the scope of the invention as presently perceived for transition surface 76 to be at any reasonable angle relative to recessed surface 74, including being generally perpendicular to recessed surface 74 or being at an acute angle with respect to recessed surface 74 so that inner edge 72 is larger than outer edge 60.

Outer portion 64 of side surface 66 of first side panel 28 defines a generally vertical outer plane indicated by line a (plane a extends perpendicular to the page in the illustrations) as shown in FIGS. 3 and 4. Recessed surface 74 also defines a plane b (plane b extends perpendicular to the page in the illustrations). Plane b is inwardly spaced apart from plane a toward interior region 30 of casket shell 12 by a distance 78 as shown best in FIG. 3.

First side panel 28 is formed to include a longitudinally extending top 86 and a longitudinally extending bottom 88. Upper rim 16 is appended to top 86 of first side panel 28 and projects outwardly therefrom to an outer surface 90 of upper rim 16 as shown in FIGS. 3 and 4. Likewise, base 14 is appended to bottom 88 of first side panel 28 and projects outwardly therefrom to an outer surface 92 of base 14. Outer surface 90 of upper rim 16 cooperates with outer surface 92 of base 14 to define a generally vertically extending plane indicated by line c (plane c extends perpendicular to the page in the illustrations). Plane c is outwardly spaced apart from plane a by a distance 94. Although plane c of illustrative casket shell 12 is not parallel to plane a, the configurations of upper rim 16 and base 14 can be adjusted so that planes a and c are parallel or are at any desired angle relative to one another without exceeding the scope of the invention as presently perceived.

Side bar 33 is outwardly spaced apart from side surface 66 of first side panel 28 as shown best in FIGS. 3 and 4. In preferred embodiments, side bar 33 is in front of and spaced apart from recessed surface 74 and is spaced apart from and positioned to He in front of plane c so that side bar 33 and bosses 34 define the outer extremities of casket shell 12. Although the preferred casket shell 12 is configured so that side bar 33 is positioned to lie in front of plane c defined by outer surface 90 of upper rim 16 and outer surface 92 of base 14, it is within the scope of the invention as presently perceived to adjust the shape of casket shell 12 or to adjust the positions of side bar 33 and recessed surface 74 so that side bar 33 is positioned to lie adjacent to plane c or even between plane a and plane c so that upper rim 16 and base 14 define the outer extremities of casket shell 12.

Lid 18 of casket 10 is carried by upper rim 16 as shown best in FIGS. 3 and 4. Lid 18 includes a lip 96 surrounding upper rim 16 and defining an outer surface 98 of lip 96 and lid 18. Outer surface 98 of lid 18 cooperates with outer surface 92 of base 14 to define a generally vertically extending plane indicated by line d (plane d extends generally perpendicular to the page in the illustrations). Plane d is outwardly spaced apart from plane a by distance 102.

In preferred embodiments, side bar 33 is outwardly spaced apart from and is positioned to lie in front of plane d so that side bar 33 and bosses 34 define the outer extremities of casket 10. Although the preferred casket 10 is configured so that side bar 33 is positioned to lie in front of plane d defined by outer surface 98 of lid 18 and outer surface 92 of base, it is within the scope of the invention as presently perceived to adjust the shape of casket shell 12 and lid 18 or to adjust the positions of side bar 33 and recessed surface 74 so that side bar 33 is positioned to lie adjacent to plane d or so that side bar 33 is positioned to lie between plane d and plane a so that outer surface 98 of lid 18 and outer surface 92 of base 14 define the outer extremities of casket 10.

Hand-grip cavity 68, defined by plane a and side surface 66 of first side panel 28 that includes outer portion 64, outer edge 60, transition surface 76, inner edge 72, and recessed surface 74, cooperates with side bar 33 and base 14 to define a hand-receiving space 71 for receiving the hand of the pallbearer. Hand-receiving space 71 is a generally serpentine-shaped space as indicated by double dashed arrow 100 as shown in FIG. 3. It can be seen that to grasp side bar 33 as shown in FIG. 4, the pallbearer snakes his fingers through hand-receiving space 71 along the path indicated by arrow 100 shown in FIG. 3.

Serpentine-shaped hand-receiving space 71 of casket shell 12 allows the pallbearer to grasp side bar 33 without engaging side surface 66 of first side panel 28 with his hand or knuckles as shown in FIG. 4. This result is achieved by having side bar 33 spaced apart from recessed surface 74 and by positioning recessed surface 74 directly behind side bar 33 by a predetermined distance 110 as shown in FIGS. 3 and 4. Predetermined distance 110 is at least a "grasping distance," which is the minimum distance that side bar 33 needs to be spaced apart from side surface 66 of first side panel 28 to allow a pallbearer to grip side bar 33 without engaging side surface 66 of first side panel 28. However, predetermined distance 110 can be greater than the grasping distance, if desired, without exceeding the scope of the invention as presently perceived. In illustrative and preferred casket shell 12, distance 110 is approximately 1.5 inches (3.8 cm), although it has been found that distance 110 can be as small as 1 ⅜ inches (3.5 cm) without causing the pallbearer to engage side surface 66 when grasping side bar 33.

Forming first side panel 28 to include hand-grip cavity 68 and placing side bar 33 in front of hand-grip cavity 68 by a distance of at least the grasping distance allows side bar 33 to be spaced apart in front of plane a by a distance 112 that is less than the grasping distance and less than predetermined distance 110. It can be seen in the illustrative and preferred casket shell 12 that the knuckles of the person carrying casket 10 pass through plane a while the person grasps side bar 33 as shown in FIG. 4, showing that distance 112 between side bar 33 and outer portion 64 of side surface 66 is less than the grasping distance.

If side surface 66 of first side panel 28 were not formed to include hand-grip cavity 68, then side bar 33 would need to be spaced apart from plane a by at least the grasping distance rather than by distance 112 that is less than the grasping distance and that is less than distance 110. Positioning side bar 33 further from plane a, and thus further from first side panel 28, requires side bar 33 and bosses 34 to project a greater distance in front of plane a than is possible when side surface 66 is formed to include hand-grip cavity 68, thus increasing the size of the envelope of space surrounding casket shell 12 that contains bars 33 and bosses 34.

Thus, including recessed portion 62, which defines hand-grip cavity 68 on first side panel 28, allows side bar 33 to be fixed to first side panel 28 closer to first side panel 28 than the grasping distance. Specifically, side bar 33 can be fixed closer to first side panel 28 than the grasping distance by distance 78 that is the distance between planes a and b, and that is the distance that recessed surface 74, and thus the innermost portion of recessed portion 62, is inwardly spaced apart from outer portion 64 of side surface 66.

Figure 5:
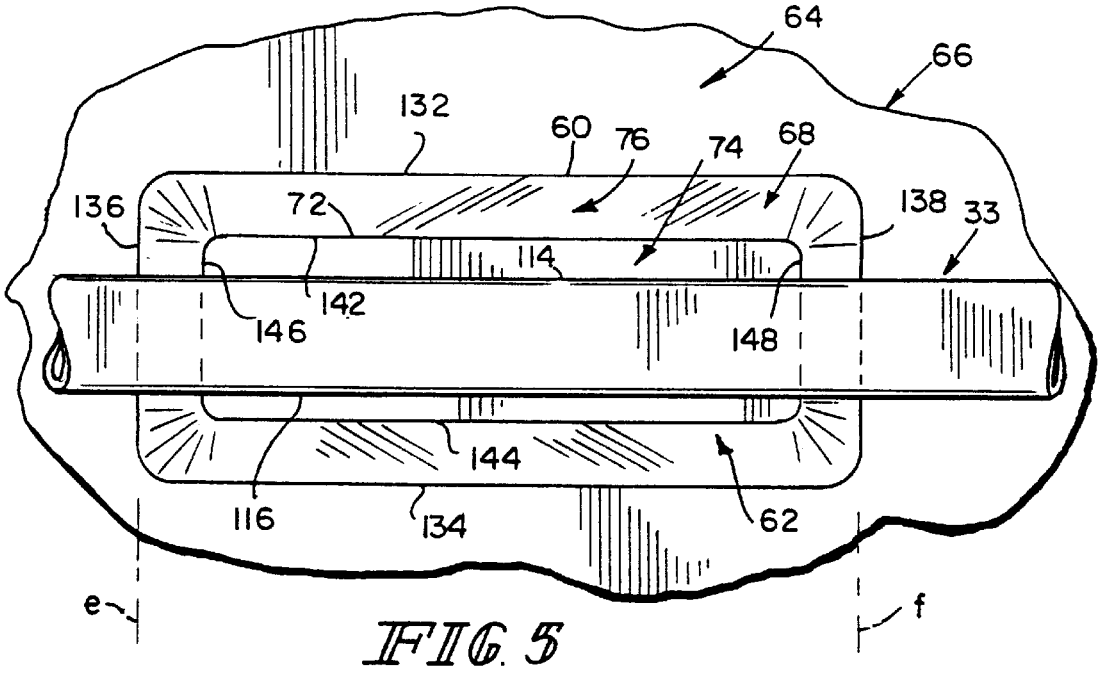
FIG. 5 is an elevation view of one of the rectangular recessed portions and one of the side bars extending in front of the recessed portion.

Side bar 33 includes an elongated top 114 and an elongated bottom 116 spaced apart from top 114 as shown in FIGS. 3–5. Top 114 is spaced apart from an uppermost portion of outer edge 60 by a distance 120 and bottom 116 is spaced apart from a lowermost portion of outer edge 60 by a distance 122 as shown in FIGS. 3 and 5. Likewise, top 114 of side bar 33 is spaced apart from an uppermost portion of inner edge 72 by a distance 124 and bottom 116 of side bar 33 is spaced apart from a lowermost portion of inner edge 72 by a distance 126.

In the illustrative and preferred embodiment, distance 120 between top 114 of side bar 33 and uppermost portion of outer edge 60 is slightly greater than distance 122 between bottom 116 of side bar 33 and the lowermost portion of outer edge 60 so that side bar 33 is positioned to lie adjacent to but slightly below a vertical center of recessed portion 62. Also, in the illustrative and preferred embodiment, the distance 124 between top 114 of side bar 33 and the uppermost portion of inner edge 72 is slightly greater than the distance 126 between bottom 116 of side bar 33 and the lowermost portion of inner edge 72 so that side bar 33 is positioned to lie adjacent to but slightly below a vertical center of recessed surface 74.

Although in the illustrative and preferred embodiment side bar 33 is positioned to lie adjacent to but slightly below the vertical center of recessed portion 62, side bar 33 can be otherwise positioned without exceeding the scope of the invention as presently perceived, so long as the pallbearer can grasp the fixed side bar 33 without engaging side surface 66 of first side panel 28 as shown in FIG. 4. For example, distance 120 between top 114 of side bar 33 and the uppermost portion of outer edge 60 can be less than distance 122 between bottom 116 of side bar 33 and the lowermost portion of outer edge 60 so that side bar 33 is positioned above the vertical center of recessed portion 62.

Also, although in the illustrative and preferred embodiment side bar 33 is positioned to lie adjacent to but slightly below the vertical center of each recessed surface 74, side bar 33 can be otherwise positioned without exceeding the scope of the invention as presently perceived, so long as the pallbearer can grasp the fixed side bar 33 without engaging side surface 66 of first side panel 28 as shown in FIG. 4. For example, distance 124 between top 114 of side bar 33 and an uppermost portion of inner edge 72 can be less than distance 126 between bottom 116 of side bar 33 and the lowermost portion of inner edge 72 so that side bar 33 is positioned above the vertical center of generally planar recessed surface 74.

It can thus be seen that side bar 33 can be infinitely positioned vertically relative to the uppermost and lowermost portions of outer edge 60 of recessed portions 62. Side bar 33 can be positioned in any vertical position relative to the uppermost and lowermost portions of outer edge 60 so long as recessed portions 62 are positioned relative to side bar 33 so that the pallbearer can grasp side bar 33 without engaging side surface 66. Likewise, it can be seen that side bar 33 can be infinitely positioned vertically relative to uppermost and lowermost portions of inner edge 72 of recessed surface 74. Side bar 33 can be positioned in any vertical position relative to the uppermost and lowermost portions of inner edge 72 so long as recessed surface 74, and thus the innermost portion of recessed portion 62, is positioned relative to side bar 33 so that the pallbearer can grasp side bar 33 without engaging side surface 66.

In addition, casket shell 12 can be formed without inner edge 72 and generally planar recessed surface 74. Instead, recessed portion 62 of side surface 66 can be shaped to have no planar surfaces. Recessed portion 62 can be rounded, recessed portion 62 can be shaped to include a cavity for each knuckle of the pallbearer, or recessed portion 62 can be formed into any other suitable shape that will allow a pallbearer to grasp side bar 33 without engaging first side panel 28. Thus, it is within the scope of the invention as presently perceived to provide a casket shell having recessed portions 62 of any shape so long as an innermost portion of each recessed portion 62 adjacent to the hand of the pallbearer is spaced apart from side bar 33 by at least the grasping distance.

As described above, side bar 33 includes a first end 46 mounted to a first boss 34 and a second end 48 mounted to a second boss 34 as shown in FIG. 1. Bosses 34 are longitudinally spaced apart along side surface 66 of first side panel 28. Recessed portions 62 are positioned to lie between bosses 34. Thus, it can be seen that side bar 33 extends across the portion side surface 28 defining recessed portions 62.

In the illustrative and preferred embodiment of casket shell 12, outer edge 60 is formed to include a top edge portion 132 defining the uppermost portion of outer edge 60, a bottom edge portion 134 defining the lowermost portion of outer edge 60, a first side edge portion 136, and a second side edge portion 138 as shown in FIG. 5. Illustratively, edge portions 132, 134, 136, 138 cooperate to define recessed portion 62 generally in the shape of a rectangle.

First side edge portion 136 defines a plane indicated by line e (plane e is perpendicular to the page in the illustration). Second side edge portion 138 defines a plane indicated by line f (plane f extends in direction perpendicular to the page in the illustration). As can be seen, side bar 33 extends in front of recessed surface 74 and through both of plane e and plane f so that side bar 33 extends along the full length of recessed portion 62.

Also, in the illustrative and preferred embodiment of casket shell 12, inner edge 72 is formed to include a top edge portion 142 defining the uppermost portion of inner edge 72, a bottom edge portion 144 defining the lowermost portion of inner edge 72, and first and second side edge portions 146, 148 defining the side-to-side extremes of inner edge 72 as shown in FIG. 5. Illustratively, edge portions 142, 144, 146, 148 cooperate to define recessed surface 74 generally in the shape of a rectangle.

Figure 6:
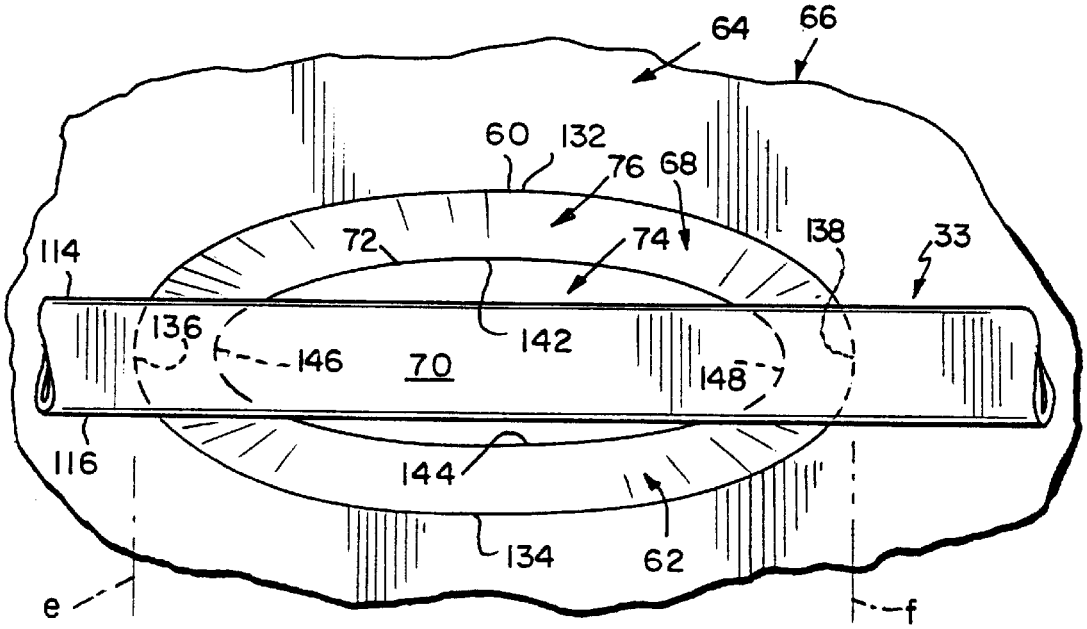
FIG. 6 is a view similar to FIG. 5 of an oval-shaped recessed portion of a casket shell and one of the side bars extending in front of the oval-shaped recessed portion.

It will be clear to those skilled in the art that although illustrative outer edge 60 and inner edge 72 both define rectangles, outer edge 60 and inner edge 72 can each define shapes other than rectangles. For example, outer edge 60 and inner edge 72 can each define ovals as shown in FIG. 6. In such instance, outer edge 60 is still formed to include a top edge portion 132 defining the uppermost portion of outer edge 60, a bottom edge portion 134 defining the lowermost portion of outer edge 60, and first and second side edge portions 136, 138 defining the side-to-side extremes of outer edge 60 as shown in FIG. 6.

First side edge portion 136 defines a plane indicated by line e (plane e is perpendicular to the page in the illustration) as shown in FIG. 6. Second side edge portion 138 defines a plane indicated by line f (plane f extends in direction perpendicular to the page in the illustration). As can be seen, side bar 33 extends in front of recessed surface 74 and through both of plane e and plane f so that side bar 33 extends along the full length of recessed portion 62.

Inner edge 72 can also be formed in the shape of an oval and can include a top edge portion 142 defining the uppermost portion of inner edge 72, a bottom edge portion 144 defining the lowermost portion of inner edge 72, and first and second side edge portions 146, 148 defining the side-to-side extremes of inner edge 72 as shown in FIG. 6. Illustratively, edge portions 142, 144, 146, 148 can cooperate to define recessed surface 74 generally in the shape of an oval as shown in FIG. 6.

It will also be clear to those skilled in the art that although illustrative and preferred transition surface 76 is a generally uniformly-sized surface as shown in FIGS. 5 and 6, inner edge 72 need not be evenly spaced apart from outer edge 60 along the entire inner edge 72. In addition, it will be clear that the shape defined by inner edge 72 need not be the same as the shape defined by outer edge 60. Thus, the size and shape of recessed portion 62 defined by outer edge 60 and of generally planar recessed surface 74 defined by inner edge 72 can be varied without exceeding the scope of the invention as presently perceived as long as side bar 33 is spaced apart from recessed surface 74 by the grasping distance so that a pallbearer can grasp side bar 33 without engaging side surface 66 of first side panel 28.

Side bar 33 includes hand grip 70 that is grasped by the pallbearer and that is defined as the portion of side bar 33 positioned to lie between plane e and plane f as shown in FIGS. 5 and 6. Thus, recessed portion 62 provides a "target" to direct the pallbearer to a specified position along side bar 33 so that the pallbearers are evenly spaced apart and properly distributed along first side panel 28 and second side panel 29 of casket shell 12 when carrying casket 10.

Although neither head end panel 27 nor foot end panel 27 of illustrative and preferred casket shell 12 are formed to include a recessed portion 62, it is within the scope of the invention as presently perceived to provide a head end panel or a foot end panel having one or more recessed portions, without exceeding the scope of the invention as presently perceived. For example, a head end panel can be provided having two corner bosses 38 and one side boss 36 mounted to the head end panel and an end bar 32 extending therebetween as shown for illustrative head end panel 26 in FIG. 1. If desired, the head end panel could be formed to include recessed portions positioned to lie between each boss 34 in a manner similar to that shown for illustrative first side panel 28 in FIG. 1.

It is also within the scope of the invention as presently perceived to provide a head end panel having two corner bosses mounted thereto, an end bar extending therebetween, and only one recessed portion formed in the head end panel behind the end bar. It is therefore within the scope of the invention as presently perceived to provide a casket shell having head and foot end panels having no recessed portions, one recessed portion, two recessed portions, or any reasonable number of recessed portions so that pallbearers can carry the casket shell by grasping bars adjacent to the end panels of the casket shell.

Figure 7:
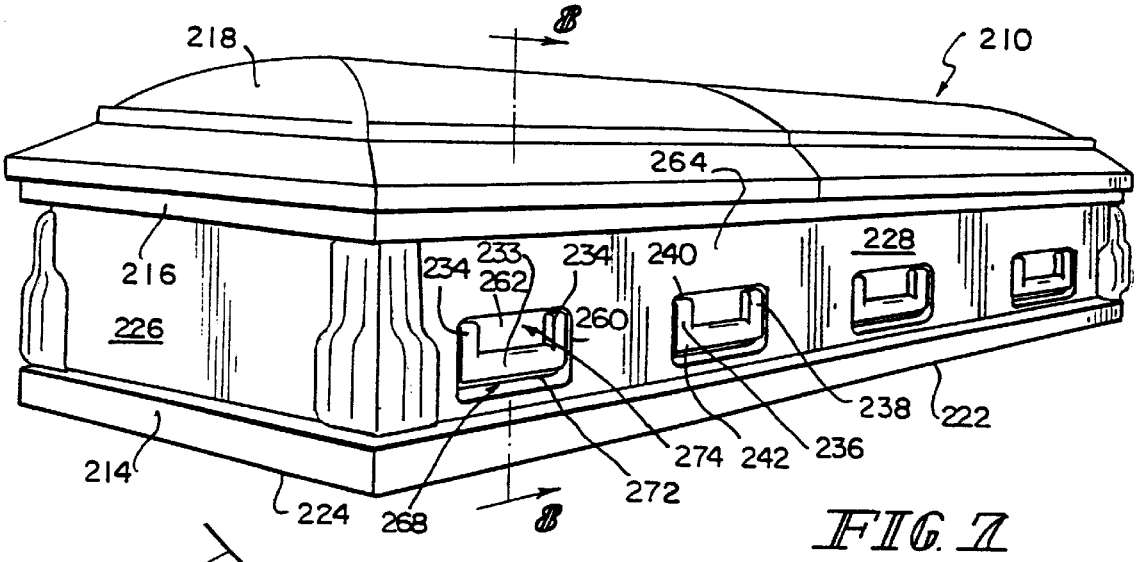
FIG. 7 is a perspective view of a second embodiment of a casket in accordance with the present invention showing a side panel of the casket shell having a side surface formed to include an outer portion, a plurality of recessed portions extending inwardly therefrom, and a plurality of side bars appended to swing hardware that is pivotably mounted the casket shell side panel, each bar being received in of one of the recessed portions and each bar having an outwardly facing surface that is flush with the outer portion of the side panel when the bar is in the downward non-operative position.
Figure 8:
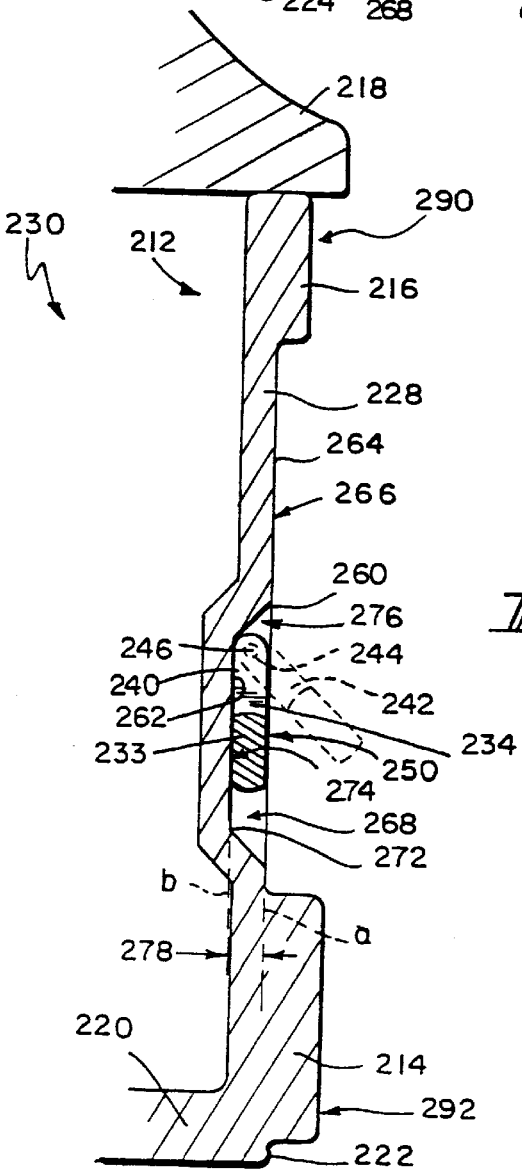
FIG. 8 is a sectional view taken along line 8—8 of FIG. 7 showing the shape of the side surface of the side panel adjacent to one of the recessed portions and the position of the side bar flush with the outer portion of the side panel when the side bar is in the downward non-operative position and spaced apart from the innermost portion of the recessed portion of the side panel when the side bar (in phantom) swings outwardly to the operative position.

A second illustrative embodiment of a casket 210 having a casket shell 212 is shown in FIG. 7. As with casket shell 12, casket shell 212 is formed to include a base 214 and an upper rim 216 as shown in FIGS. 7 and 8. A lid 218 is attached to rim 216 by conventional hinging mechanisms (not shown) and is movable between a closed position, shown in FIG. 7, and an open position having lid 218 away from rim 216 to display the contents of casket shell 212.

Casket shell 212 includes an elongated bottom 220 having an elongated first side edge 222, an elongated second side edge (not shown) spaced apart from first side edge 222, a head end edge 224, and a foot end edge (not shown) that is longitudinally spaced apart from head end edge 224. A head end panel 226 is attached to head end edge 224 and extends upwardly therefrom, a foot end panel (not shown) is attached to the foot end edge and extends upwardly therefrom, a first side panel 228 is attached to the first side edge and extends upwardly therefrom, and a second side panel (not shown) is attached to the second side edge and extends upwardly therefrom.

First side panel 228 and the second side panel cooperate with bottom 220, head end panel 226, and the foot end panel to define an interior region 230 of casket shell 212. Preferably, first side panel 228 and the second side panel are of unitary construction and can be formed by stamping first side panel 228 and the second side panel from a sheet of material, by molding the first side panel 228 and the second side panel, or by any other suitable forming process without exceeding the scope of the invention as presently perceived.

As with the first embodiment of casket shell 12, the foot end panel of casket shell 212 is substantially similar to head end panel 226 and the second side panel of casket shell 212 is substantially similar to first side panel 228. The description herein related to head end panel 226 is thus descriptive of the foot end panel and the description herein related to first side panel 228 is descriptive of the second side panel. Therefore, unless otherwise noted, the description below of head end panel 226 will also apply to the foot end panel and the description below of first side panel 228 will also apply to the second side panel.

First side panel 228 is formed to include an outwardly facing side surface 266 having a plurality of longitudinally spaced-apart edges 260. Each edge 260 defines a recessed portion 262 of side surface 266 that is recessed inwardly from an outer portion 264 of side surface 266. Each recessed portion 262 defines a hand-grip cavity 268 as shown in FIGS. 7 and 8.

Each recessed portion 262 of casket shell 212 is preferably substantially similar to each other recessed portion 262 formed in side surface 266. The description below of one of recessed portions 262 with reference to FIG. 8 is descriptive of each recessed portion 262, and the description below of preferred recessed portion 262 should be taken as a description of each recessed portion 262 of side surface 266 of casket shell 212.

Edge 260 of side surface 266 of casket shell 212 is an outer edge of recessed portion 262 as shown in FIGS. 7 and 8. Recessed portion 262 also preferably includes an inner edge 272 defining a generally planar surface 274 that preferably also defines an innermost portion of recessed portion 262. A transition surface 276 is positioned to lie between outer edge 260 and inner edge 272. Although illustrative transition surface 276 is shown to incline gradually inwardly from outer edge 260 to inner edge 272 defining a ramped portion therebetween, it is within the scope of the invention as presently perceived for transition surface 276 to be at any reasonable angle relative to recessed surface 274, such as being generally perpendicular to recessed surface 274 or being at an acute angle with respect to recessed surface 274 so that inner edge 272 is larger than outer edge 260.

Outer portion 264 of side surface 266 of first side panel 228 defines a generally vertical outer plane indicated by line a (plane a extends perpendicular to the page in the illustrations) as shown in FIG. 8. Recessed surface 274 also defines a plane b (plane b extends perpendicular to the page in the illustrations). Plane b is inwardly spaced apart from plane a toward interior region 230 of casket shell 212 by a distance 278 as shown in FIG. 8.

A side bar 233 is appended to swing hardware 234 as shown in FIGS. 7 and 8 and swing hardware 234 is pivotably coupled to first side panel 228 so that side bar 233 can swing between a downward non-operative position outwardly to an operative position when the casket is carried. Illustrative swing hardware 234 includes first and second arms 236, 238, each arm 236, 238 having a proximal end 240 pivotably coupled to first side panel 228 and a distal end 242 attached to side bar 233.

Preferably, each arm 236, 238 includes a pin 244 appended to proximal end 240 and extending generally horizontally away from side bar 233, pins 244 defining a pivot axis 246 of swing hardware 234 as shown in FIG. 8. Transition surface 276 is formed to include a pair of opposing handle-receiving voids, such as openings or apertures (not shown), each of which rotatably receives one of pins 244 so that swing hardware 234 and side bar 233 can swing relative to first side panel 228.

Side bar 233 and swing hardware 234 are received in hand-grip cavity 268 as shown in FIGS. 7 and 8 when side bar 233 is in the non-operative position. Side bar 233 and swing hardware 234 are formed to include an outwardly facing surface 250 that is preferably generally coplanar with plane a when side bar 233 and swing hardware 234 are in the downward non-operative position as shown in FIG. 8. Thus, an outer surface 290 of upper rim 216 and an outer surface 292 of base 214 define the outer extremities of casket shell 212 when side bar 233 is in the non-operative position. Side bar 233 and swing hardware 234 extend outwardly from plane a when in the operative position so that side bar 233 can be easily grasped by a pallbearer carrying casket 210.

An outer surface 292 of base 214 of casket shell 212 defines the outermost extremity of casket shell 212 as shown best in FIG. 8. Forming casket shell 212 without bosses 34 or other hardware extending outwardly beyond outer surface 292 provides an efficient utilization of space allowing for the size of casket shell 212 to be maximized while still keeping the outer extremities of casket 210 within the limited envelope of space surrounding casket shell 212.

Preferably, side bar 233 and first and second arms 236, 238 of swing hardware 234 are of unitary construction as shown in FIGS. 7 and 8. However, it is within the scope of the invention as presently perceived to provide a separate side bar made from a plastics material, metal, wood, or any other suitable material and separate first and second arms 236, 238 made from a plastics material, metal, wood, or any other suitable material that are coupled to first side panel 228 and positioned as described above.

Illustrative casket shell 12 is shown in FIGS. 1 and 2 to provide four recessed portions 62 and five bosses 34 on each of the first and second side panels 28, 29, and casket shell 312 is shown in FIG. 7 to provide four recessed portions 262 on first side panel 228. However, side panels 28, 29, 228 may be formed to include any number of spaced-apart recessed portions 62, 262 which may be interleaved between bosses 34 as desired without exceeding the scope of the invention as presently perceived.

For example, a casket shell 412 can be a shell for an "over-sized" casket and can include side panels 428, 429, each of which is formed to include five recessed portions 62, 262 (as indicated by reference numerals 62 in the illustration) as shown diagrammatically in FIG. 9. For another example, a casket shell 512 can be a shell for an "under-sized" casket for infants, children, or other under-sized people or animals and can include side panels 528, 529, each of which is formed to include three recessed portions 62, 262 (as indicated by reference numerals 62 in the illustration) as shown diagrammatically in FIG. 10, or a casket shell 612 can include side panels 628, 629, each of which is formed to include two recessed portions 62, 262 (as indicated by reference numerals 62 in the illustration) as shown diagrammatically in FIG. 11. It can be seen, then, that casket shell 12, 212 can be formed to include any desired and reasonable number of recessed portions 62, 262 for defining hand-grip cavities 68, 268 without exceeding the scope of the invention as presently perceived.

Casket shell 12 in accordance with the present invention having a handle including recessed portions 62 and side bar 33 provides a casket 10 that is conveniently sized for fitting within a limited envelope of space surrounding casket 10 during storage, during transport on shipping pallets (not shown) or in other shipping containers (not shown), and during use when casket 10 is placed into a mausoleum (not shown) or a burial vault (not shown). Side bar 33 of casket shell 12 is fixed relative to first side panel 28 and relative to recessed portions 62. Thus, casket 10 includes no moving hardware that can swing during shipment or during other handling operations of casket 10, thereby eliminating the possibility of damaging adjacent caskets, damaging casket 10, damaging such movable hardware, or damaging any adjacent objects.

However, if it is desired to mount side bar 233 on swing hardware 234 so that side bar 233 can swing relative to the casket shell 212, casket shell 212 can accommodate swing hardware 234 by positioning side bar 233 and swing hardware 234 within recessed portions 262. Preferably, side bars 233 and swing hardware 234 are mounted so that side bars 233 are received by recessed portions 262 and are flush with generally vertical plane a defined by outer portion 264 of side surface 266 when side bars 233 are in the downward non-operative position. Also, preferred side bars 233 swing outwardly to the operative position when casket 210 is carried. Mounting side bars 233 and swing hardware 234 within hand-grip cavity 268 provides for an efficient use of space allowing the size of casket shell 212 to be maximized while still fitting within the limited envelope of space surrounding casket 210.

Figure 29:
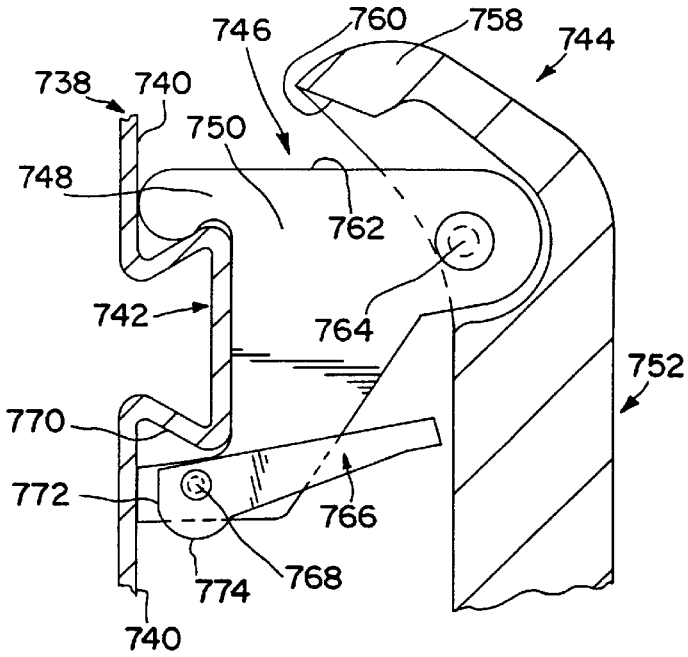
FIG. 29 is a sectional view of a thirteenth alternative embodiment boss showing a metal sheet of a casket side wall being formed to include a male dove-tail rail that defines the boss, a swing handle assembly having a female dove-tail arm that slides onto the dove-tail rail to couple the side bar to the casket side wall, the swing handle assembly having a cam latch coupled to the female dove-tail arm for pivoting movement beneath the dove-tail rail, and the swing handle assembly having a swing arm coupled to a distal end of the female dove-tail arm for pivoting movement.
Figure 30:
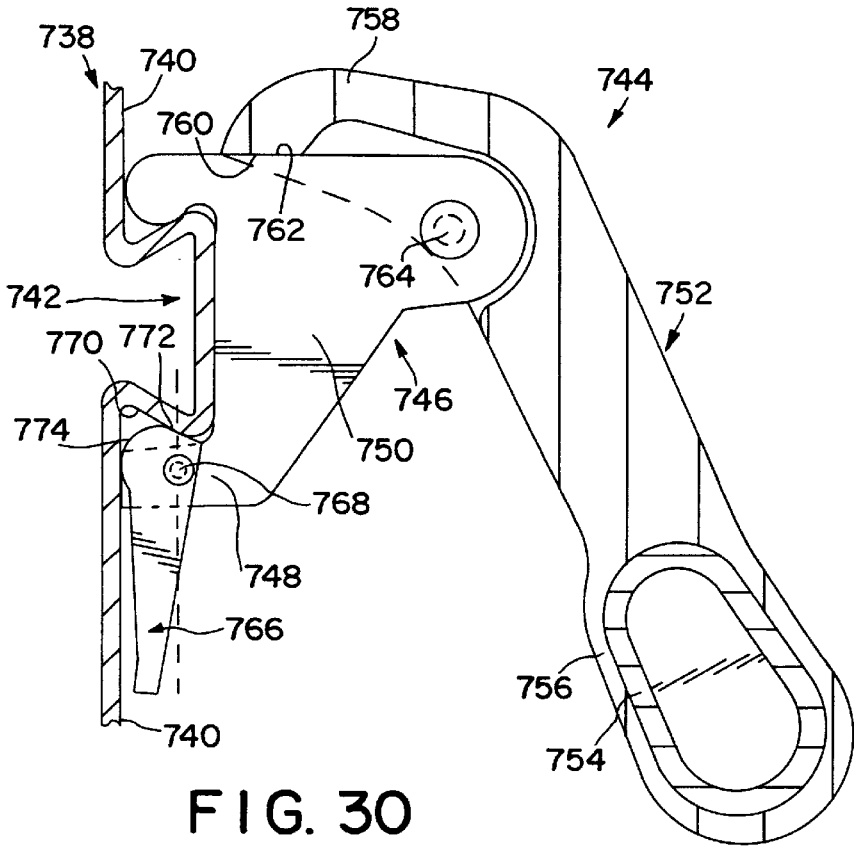
FIG. 30 is a sectional view similar to FIG. 29 showing the cam latch pivoted to a locking position in which the female dove-tail arm is prevented from sliding on the male dove-tail rail and the swing arm pivoted to a use position having a grip bar of the swing handle assembly moved away from the casket side wall.

According to the present invention, a number of casket embodiments with contiguous, integral hardware bosses is provided. The hardware bosses can be external hardware bosses, as shown in FIGS. 12–18, or internal hardware bosses, as shown in FIGS. 19–23. In addition, the hardware bosses can be channels debossed into a side wall of a casket shell, as shown in FIGS. 24–28, or rails embossed out of the side wall of the casket shell, as shown in FIGS. 29 and 30. In each embodiment, the casket includes one or more handle bars that mount to the contiguous, integral hardware bosses.

Figure 12:
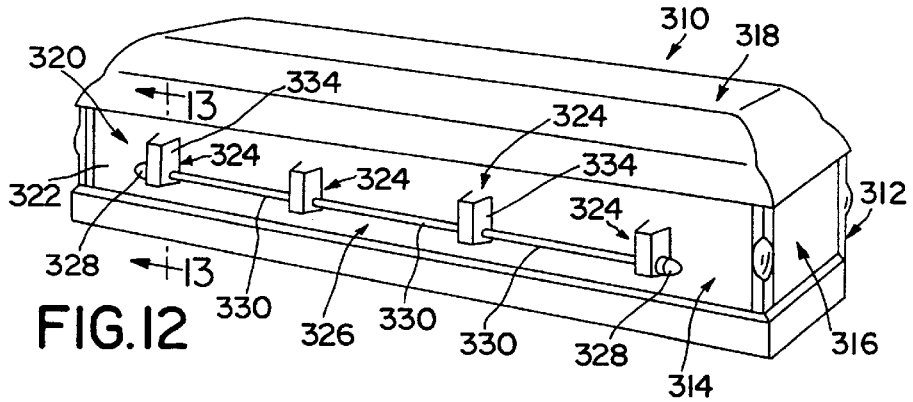
FIG. 12 is a perspective view of a third alternative embodiment casket according to the present invention showing a side wall of the casket shell formed to include a plurality of bosses and a side handle bar coupled to the bosses.

A third embodiment casket 310 includes a casket shell 312 having side walls 314 and end walls 316 as shown in FIG. 12. Casket 310 includes a lid 318 that covers an interior region of casket shell 312 when in a closed position. Lid 318 is movable to an opened position to display the contents of casket shell 312. Side walls 314 include a substantially planar main portion 320 having an outwardly facing surface 322. Side walls 314 are formed to include a plurality of external hardware bosses 324 that protrude outwardly from main portion 320. Casket 310 includes a pair of side handle bars 326 that couple to bosses 324 formed in respective side walls 314. Each side handle bar 326 includes first and second ends (not shown) to which end caps 328 mount. End caps 328 engage the bosses 324 that are closest to respective end walls 316 to constrain respective side handle bars 326 from moving longitudinally relative to casket shell 312. Side handle bars 326 each include gripping portions 330 that are positioned to lie between bosses 324 and that are gripped to carry casket 310.

Figure 13:
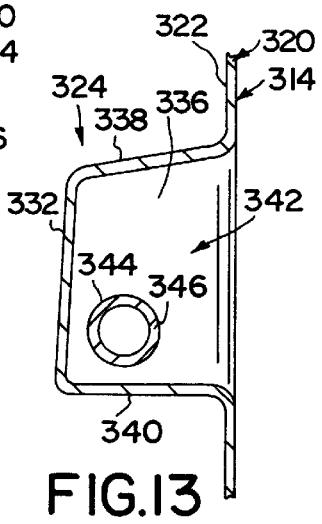
FIG. 13 is a sectional view taken along line 13—13 of FIG. 12 showing the side wall of the casket being made from a sheet of metal, the boss formed in the sheet of metal, and apertures formed in the boss for receiving the side handle bar.

Side walls 314 can be made from sheets of metal, as shown in FIG. 13, or from a plastics material. If side walls 314 are made from sheets of metal, bosses 324 are stamped, or otherwise formed, into the sheets of metal. If side walls 314 are made from a plastics material, bosses 324 are molded along with main portions 320. Thus, bosses 324 are contiguous and integral with main portions 320 of side walls 314. Each boss 324 of casket shell 312 is preferably substantially similar to each other boss 324. Thus, the description below of one of bosses 324, particularly with reference to FIG. 13, is descriptive of each of bosses 324 unless specifically noted otherwise.

Boss 324 includes a protruded wall 332, a first transition wall 334 connecting protruded wall 332 with main portion 320 of side wall 314, and a second transition wall 336 connecting protruded wall 332 with main portion 320 of side wall 314. Boss 324 also includes a top transition wall 338 connecting protruded wall 332 with main portion 320 of side wall 314 and connecting first and second transition walls 334, 336 together. In addition, boss 324 includes a bottom transition wall 340 connecting protruded wall 332 with main portion 320 of side wall 314 and connecting first and second transition walls 334, 336 together. Thus, protruded wall 332 is integrally connected to main portion 320 of side wall 314 by transition walls 334, 336, 338, 340. In addition, boss 324 has an interior region 342 bounded by walls 332, 334, 336, 338, 340 thereof.

First and second transition walls 334, 336 are each formed to include an aperture 344 as shown in FIG. 13. Apertures 344 are longitudinally aligned and side handle bar 326 extends through boss 324 so that a portion 346 of side handle bar 326 is positioned to lie inside interior region 342 of boss 324. Apertures 344 are shaped and sized to closely mate with the shape and size of side handle bar 326 so that the clearance between side handle bar 326 and first and second transition walls 334, 336 is adequately minimized. For example, side handle bar 326 and apertures 344 of casket 310 are both round and have substantially the same diameter as shown in FIG. 13. When gripping portions 330 of side handle bar 326 are used to carry casket 310, the weight of casket 310 and the contents in the interior region of casket shell 312 is transmitted to side handle bars 326 through bosses 324. By providing casket 310 with bosses 324 that are contiguous and integral with main portions 320 of side walls 314, the need to use bolts or screws to attach separate bosses to side walls 314 is eliminated.

Although bosses 324 are shown in FIGS. 12 and 13 as being somewhat box-shaped having corners that render walls 332, 334, 336, 338, 340 easily identifiable, it is within the scope of the invention as presently perceived for bosses 324 to have any one of a number of other shapes. For example, one or more of walls 332, 334, 336, 338, 340 could be blended together more smoothly so that the point at which boss material is considered to be part of any one of walls 332, 334, 336, 338, 340 is less discernable. For example, bosses 324 could be substantially dome-shaped. In addition, bosses 324 can be embossed, debossed, painted, or otherwise modified to provide bosses 324 with a decorative appearance.

Figure 14:
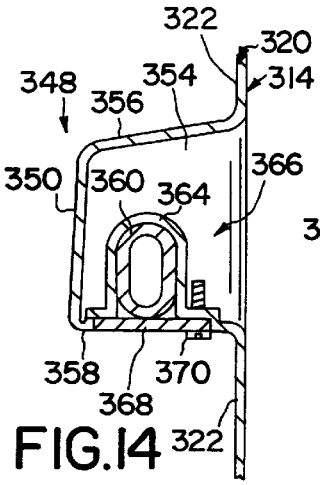
FIG. 14 is a view similar to FIG. 13 showing a first alternative embodiment boss in which the boss is formed in a sheet of metal so as to include a U-shaped channel extending through the boss, a side handle bar of oval cross section received in the channel, and a bottom plate trapping the side handle bar in the channel.

One of a set of first alternative embodiment bosses 348, which are similar to bosses 324 and which can be formed in side walls 314 of casket 310 in lieu of bosses 324, is shown in FIG. 14. The description below of a single boss 348 is descriptive of all of bosses 348 unless specifically noted otherwise. Boss 348 includes a protruded wall 350, a first transition wall (not shown), a second transition wall 354, and a top transition wall 356, each of which are similar to respective walls 332, 334, 336, 338 of boss 324. However, the first transition wall and second transition wall 354 of boss 348 are each provided with a U-shaped slot and casket 310 is provided with an alternative side handle bar 360 having an oval cross section as shown in FIG. 14.

Boss 348 includes a bottom transition wall 358 connecting protruded wall 350 with main portion 320 of side wall 314 and connecting the first transition wall with second transition wall 354. Bottom transition wall 358 includes a central portion 364, shown in FIG. 14, having a U-shaped cross section that conforms to the shape of the slots formed in the first transition wall and second transition wall 354. Thus, U-shaped central portion 364 cooperates with the U-shaped slots formed in the first transition wall and second transition wall 354 to provide a longitudinal U-shaped channel extending through boss 348. Boss 348 has an interior region 366 bounded by the first transition wall and walls 350, 354, 356, 358. Side handle bar 360 is received in the longitudinal U-shaped channel outside of interior region 366.

A retaining plate 368 is provided for retaining side handle bar 360 in the longitudinal U-shaped channel of boss 348. Plate 368 is coupled to bottom transition wall 358 by suitable fastening means, such as by use of an adhesive, by welding, or by use of a bolt 370 as shown in FIG. 14. In the embodiment shown in FIG. 14, a portion of bottom transition wall 358 is recessed to accommodate retaining plate 368. When side handle bars 360 are used to carry casket 310, the weight of casket 310 and the contents in the interior region of casket shell 312 is transmitted to side handle bars 360 through bosses 348.

Figure 15:
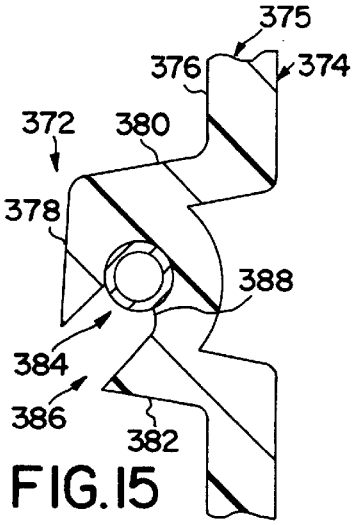
FIG. 15 is a view similar to FIG. 13 showing a second alternative embodiment boss that is molded out of a plastics material and integral with the side wall, the boss being formed to include a bar-receiving channel, and the boss being formed to include a detent that secures a handle bar in place.

Side walls 314 having either bosses 324 or bosses 348 formed therein can be made out of sheets of metal or out of a plastics material as previously described. One of a set of second alternative embodiment bosses 372 which are formed in a casket (not shown) having thick side walls 374 made out of a plastics material is shown in FIG. 15. Each side wall 374 includes a main portion 375 having an outwardly facing surface 376. The description below of a single boss 372 is descriptive of all of bosses 372 unless specifically noted otherwise.

Boss 372 includes a protruded wall 378, a first transition wall (not shown), a second transition wall (not shown), a top transition wall 380, and a bottom transition wall 382 as shown in FIG. 15. A longitudinal bar-receiving channel 384 is formed through boss 372 between the first and second transition walls thereof Boss 372 is provided with an opening 386 which side handle bar 326 passes through when inserted into channel 384 during assembly. Thus, boss 372 is substantially a solid piece of plastics material except for the portion of material absent from channel 384 and opening 386. The first and second transition walls and walls 378, 380, 382 can be embossed, debossed, or otherwise decorated to camouflage channel 384 and opening 386.

In the illustrative embodiment of boss 372, opening 386 is formed in the region where protruded wall 378 and bottom transition wall 382 would otherwise meet. Other configurations of channel 384 and other locations of opening 384 are possible. A plug (not shown) can be provided for filling opening 386 and a portion of channel 384 after side handle bar 326 is inserted into channel 384. Boss 372 includes a detent 388 that retains side handle bar 326 in channel 384 after the insertion of side handle bar 326 into channel 384. When side handle bars 326 are used to carry the casket associated with bosses 372, the weight of the casket and the contents therein is transmitted to side handle bars 326 through bosses 372.

Figure 16:
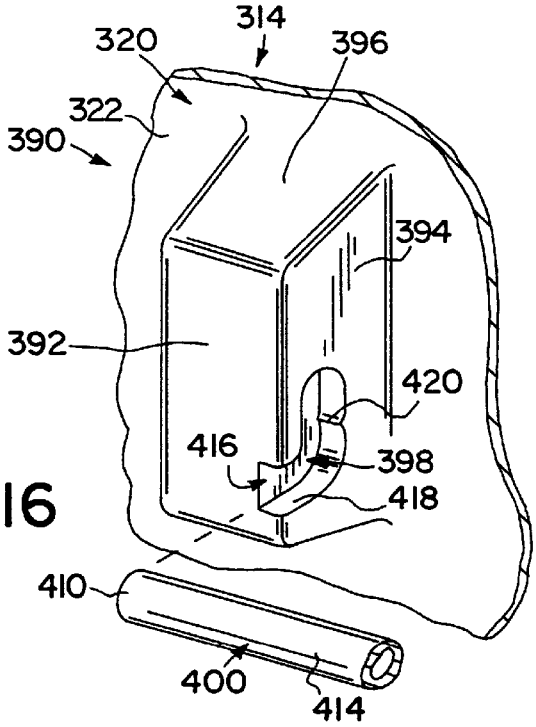
FIG. 16 is a perspective view of a third alternative embodiment boss showing the boss extending away from a casket side wall, a transition wall of the boss being formed to include an L-shaped groove, and a handle bar aligned with an opening of the L-shaped groove.

One of a set of third alternative embodiment bosses 390, which are similar to bosses 324 and which can be formed in side walls 314 of casket 310 in lieu of bosses 324, is shown in FIG. 16. The description below of a single boss 390 is descriptive of all of bosses 390 unless specifically noted otherwise. Boss 390 includes a protruded wall 392, a first transition wall 394, a second transition wall (not shown), a top transition wall 396, and a bottom transition wall (not shown), each of which are similar to respective walls 332, 334, 336, 338, 340 of boss 324. However, first transition wall 394 of boss 390 is formed to include an L-shaped groove 398. An alternative embodiment side handle bar 400 includes a first end 410 received in groove 398 and a gripping portion 414 positioned to lie outside groove 398. Protruded wall 392 is formed to include an opening 416 which first end 410 of side handle bar 400 passes through during insertion of side handle bar 400 into groove 398.

First transition wall 394 includes an edge 418 that defines L-shaped groove 398 as shown in FIG. 16. Edge 418 is formed to include a detent 420 that engages end 410 of side handle bar 400 to hold side handle bar 400 in place relative to boss 390. Detent 398 is sized to allow end 410 of side handle bar 400 to snap into place during the installation of side handle bar 410. When side handle bar 400 is used to lift casket 310, end 410 of side handle bar 400 engages a top curved portion of edge 418 and when casket 310 is at rest on a supporting structure (not shown), detent 420 engages end 410 of side handle bar 400 to prevent side handle bar from falling downwardly away from the top curved portion of edge 418.

Figure 17:
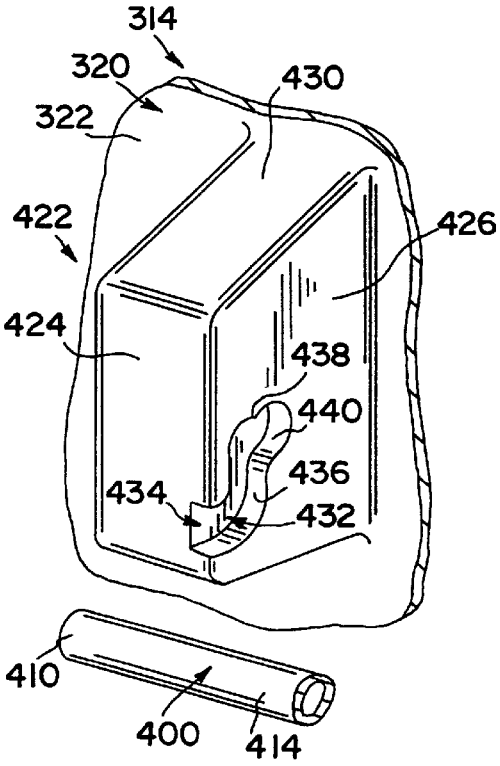
FIG. 17 is a perspective view of a fourth alternative embodiment boss showing the boss extending away from a casket side wall, a transition wall of the boss being formed to include an S-shaped groove, and a handle bar aligned with an opening of the S-shaped groove.

One of a set of fourth alternative embodiment bosses 422, which are similar to bosses 324 and which can be formed in side walls 314 of casket 310 in lieu of bosses 324, is shown in FIG. 17. The description below of a single boss 422 is descriptive of all of bosses 422 unless specifically noted otherwise. Boss 422 includes a protruded wall 424, a first transition wall 426, a second transition wall (not shown), a top transition wall 428, and a bottom transition wall (not shown), each of which are similar to respective walls 332, 334, 336, 338, 340 of boss 324. However, first transition wall 426 of boss 422 is formed to include an S-shaped groove 432. First end 410 of side handle bar 400 is received in groove 432 and gripping portion 414 of side handle bar 400 is positioned to lie outside groove 432. Protruded wall 424 is formed to include an opening 434 which first end 410 of side handle bar 400 passes through during insertion of side handle bar 400 into groove 432.

First transition wall 426 includes an edge 436 that defines S-shaped groove 432 as shown in FIG. 17. Edge 436 is formed to include a detent 438 that engages end 410 of side handle bar 400 to hold side handle bar 400 in place relative to boss 422. Detent 438 is sized to allow end 410 of side handle bar 400 to snap into place during the installation of side handle bar 410. When side handle bar 400 is used to lift casket 310, end 410 of side handle bar 400 engages a top curved portion of edge 418 and when casket 310 is at rest on a supporting structure (not shown), end 410 of side handle bar 400 is supported on a ledge portion 440 of edge 436. In addition, detent 438 limits the ease with which side handle bar 400 can be pulled transversely away from main portion 320 of side wall 314.

Figure 18:
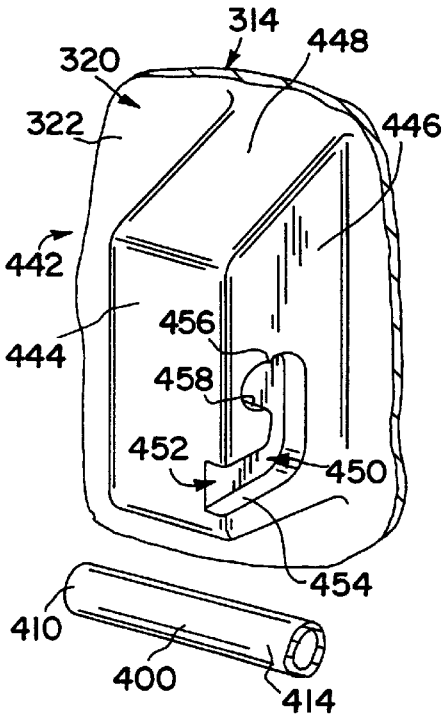
FIG. 18 is a perspective view of a fifth alternative embodiment boss showing the boss extending away from a casket side wall, a transition wall of the boss being formed to include a C-shaped groove, and a handle bar aligned with an opening of the C-shaped groove.

One of a set of fifth alternative embodiment bosses 442, which are similar to bosses 324 and which can be formed in side walls 314 of casket 310 in lieu of bosses 324, is shown in FIG. 18. The description below of a single boss 442 is descriptive of all of bosses 442 unless specifically noted otherwise. Boss 442 includes a protruded wall 444, a first transition wall 446, a second transition wall (not shown), a top transition wall 448, and a bottom transition wall (not shown), each of which are similar to respective walls 332, 334, 336, 338, 340 of boss 324. However, first transition wall 446 of boss 442 is formed to include a C-shaped groove 450. First end 410 of side handle bar 400 is received in groove 450 and gripping portion 414 of side handle bar 400 is positioned to lie outside groove 450. Protruded wall 444 is formed to include an opening 452 which first end 410 of side handle bar 400 passes through during insertion of side handle bar 400 into groove 450.

First transition wall 446 includes an edge 454 that defines C-shaped groove 450 as shown in FIG. 18. Edge 454 is formed to include a detent 456 that engages end 410 of side handle bar 400 to hold side handle bar 400 in place relative to boss 442. Detent 456 is sized to allow end 410 of side handle bar 400 to snap into place during the installation of side handle bar 410. When side handle bar 400 is used to lift casket 310, end 410 of side handle bar 400 engages a top curved portion of edge 418 and when casket 310 is at rest on a supporting structure (not shown), end 410 of side handle bar 400 is supported on a ledge portion 458 of edge 454. In addition, detent 456 limits the ease with which side handle bar 400 can be pushed transversely toward main portion 320 of side wall 314.

Although grooves 398, 432, 450 of bosses 390, 422, 442 are L-shaped, S-shaped, and C-shaped, respectively, it is within the scope of the invention as presently perceived for grooves of other shapes to be provided in external bosses of casket 310. For example, grooves extending transversely, grooves extending vertically, or straight grooves that are angled could be provided. It is within the scope of the invention as presently perceived for any of bosses 390, 422, 442 to be formed decoratively so as to camouflage respective openings 416, 434, 452 or to include plugs that fill respective openings 416, 434, 452 and a portion of the associated grooves 398, 432, 450. In addition, although bosses 390, 422, 442 are shown in FIGS. 16-18, respectively, as being somewhat box-shaped, it is within the scope of the invention as presently perceived for bosses 324 to have any one of a number of other shapes as was the case with boss 324. For example, bosses 390, 422, 442 can be substantially dome-shaped and can be embossed, debossed, painted, or otherwise modified to provide bosses 390, 422, 442 with a decorative appearance.

Figure 19:
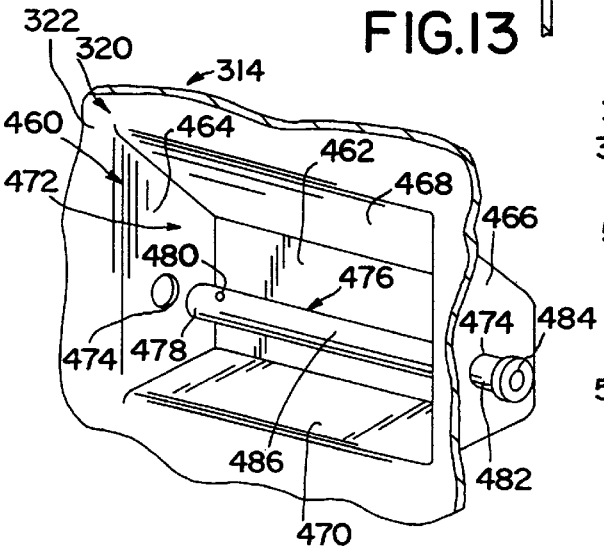
FIG. 19 is a perspective view of a sixth alternative embodiment boss showing the boss defining a recessed cavity in a casket side wall, transition walls of the boss each being formed to include an aperture, and a handle bar formed with a flange on one end and a detent near the other end.

Instead of external bosses, such as bosses 324, 348, 372, 390, 422, 442 that protrude outwardly from the associated casket shell, casket 310 can alternatively be provided with internal bosses that are recessed inwardly as previously described. For example, a sixth alternative boss 460 includes a recessed wall 462, a first transition wall 464 connecting recessed wall 462 with main portion 320 of side wall 314, and a second transition wall 466 connecting recessed wall 462 with main portion 320 of side wall 314 as shown in FIG. 19. Boss 460 also includes a top transition wall 468 connecting recessed wall 462 with main portion 320 of side wall 314 and connecting first and second transition walls 464, 466 together. In addition, boss 460 includes a bottom transition wall 470 connecting recessed wall 462 with main portion 320 of side wall 314 and connecting first and second transition walls 464, 466 together. Thus, recessed wall 462 is integrally connected to main portion 320 of side wall 314 by transition walls 464, 466, 468, 470. In addition, boss 460 has a cavity 472 bounded by walls 462, 464, 466, 468, 470 thereof.

First and second transition walls 464, 466 are each formed to include an aperture 474 as shown in FIG. 19. An alternative side handle bar 476 includes a first end 478 having a detent 480, a second end 482 having an annular flange 484, and a gripping portion 486 between first and second ends 478, 482. During assembly, side handle bar 476 is inserted through apertures 444 until detent 480 snaps past first and second transition walls 464, 466 at which point annular flange 484 is adjacent to second transition wall 466. After side handle bar 476 is mounted to boss 460, gripping portion 486 is positioned to lie in cavity 472, first and second ends 478, 482 are received in respective apertures 474 formed in first and second transition walls 464, 466, and detent 480 and annular flange 484 engage respective first and second transition walls 464, 466 to prevent longitudinal movement of side handle bar 476 relative to boss 460. When gripping portion 486 of side handle bar 476 is used to carry casket 310, the weight of casket 310 and the contents in the interior region of casket shell 312 is transmitted to side handle bars 476 through boss 460.

Figure 20:
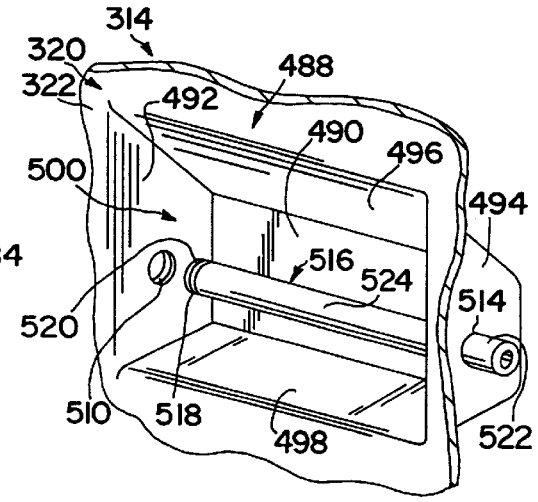
FIG. 20 is a perspective view of a seventh alternative embodiment boss showing the boss defining a recessed cavity in a casket side wall, transition walls of the boss each being formed to include an aperture, one of the apertures being bounded by a threaded edge, and a handle bar having one end formed with a thread that engages the threaded edge.

A seventh alternative boss 488, shown in FIG. 20, includes a recessed wall 490, a first transition wall 492, a second transition wall 494, a top transition wall 496, and a bottom transition wall 498 that are similar to walls 462, 464, 466, 468, 470, respectively, of boss 460. Boss 488 has a cavity 500 bounded by walls 490, 492, 494, 496, 498 thereof First transition wall 492 is formed to include a threaded aperture 510 and second transition wall 494 is formed to include an unthreaded aperture 514.

An alternative side handle bar 516 includes a first end 518 formed with a thread 520, a second end 522 spaced apart from first end 518, and a gripping portion 524 between first and second ends 518, 522. During assembly, side handle bar 516 is inserted through aperture 514 and is rotated so that first end threadedly engages aperture 510. Side handle bar 516 can be rotated into a tightened configuration having thread 520 completely received in threaded aperture 510. Receipt of thread 520 in threaded aperture 510 prevents longitudinal movement of side handle bar 516 relative to boss 488. After side handle bar 516 is mounted to boss 488, gripping portion 524 is positioned to lie in cavity 500 and first and second ends 518, 522 are received in respective apertures 510, 514 formed in first and second transition walls 492, 494. When gripping portion 524 of side handle bar 516 is used to carry casket 310, the weight of casket 310 and the contents in the interior region of casket shell 312 is transmitted to side handle bars 516 through boss 488.

Figure 21:
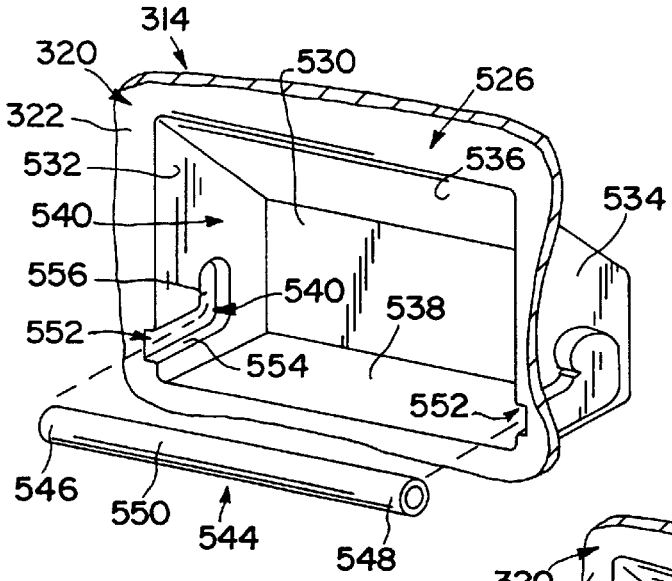
FIG. 21 is a perspective view of an eighth alternative embodiment boss showing the boss defining a recessed cavity in a casket side wall, transition walls of the boss each being formed to include an L-shaped groove, and a handle bar aligned with openings of the L-shaped grooves.

An eighth alternative boss 526, shown in FIG. 21, includes a recessed wall 530, a first transition wall 532, a second transition wall 534, a top transition wall 536, and a bottom transition wall 538 that are similar to walls 462, 464, 466, 468, 470, respectively, of boss 460. Boss 526 has a cavity 540 bounded by walls 530, 532, 534, 536, 538 thereof First and second transition walls 532, 534 are each formed to include an L-shaped groove 542. An alternative side handle bar 544 includes a first end 546, a second end 548 spaced apart from first end 546, and a gripping portion 550 between first and second ends 546, 548. First and second ends 546, 548 of side handle bar 544 are received in L-shaped grooves 542 of respective first and second transition walls 532, 534 and gripping portion 550 of side handle bar 544 is positioned to lie outside grooves 542 and inside cavity 540. Main portion 320 of side wall 314 is formed to include a pair of openings 552 which respective first and second ends 546, 548 of side handle bar 544 pass through during insertion into grooves 542.

First and second transition walls 532, 534 each include an edge 554 that defines the respective L-shaped groove 542 as shown in FIG. 21. Each edge 554 is formed to include a detent 556 that engages respective first and second ends 546, 548 of side handle bar 544 to hold side handle bar 544 in place relative to boss 526. Detents 556 are sized to allow ends 546, 548 of side handle bar 544 to snap into place during the installation of side handle bar 554. When side handle bar 544 is used to lift casket 310, ends 546, 548 of side handle bar 544 engage respective top curved portions of edges 554 and when casket 310 is at rest on a supporting structure (not shown), detents 556 engage respective ends 546, 548 of side handle bar 544 to prevent side handle bar 544 from falling downwardly away from the top curved portions of edges 554.

Figure 22:
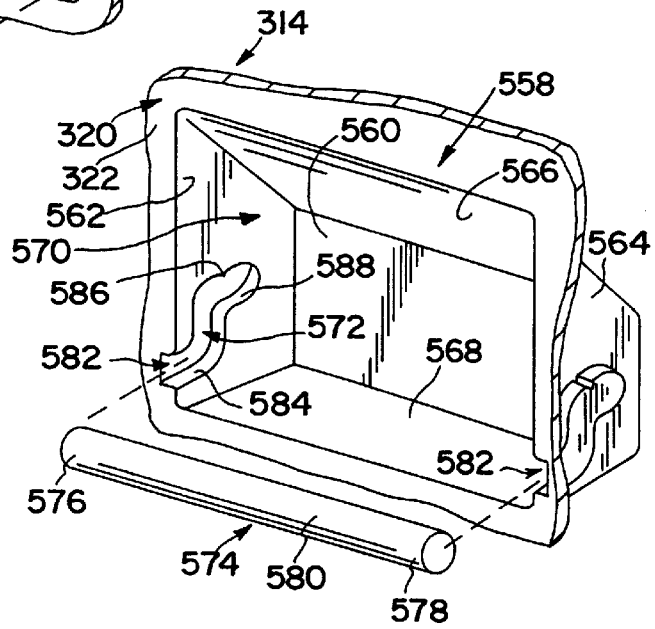
FIG. 22 is a perspective view of a ninth alternative embodiment boss showing the boss defining a recessed cavity in a casket side wall, transition walls of the boss each being formed to include an S-shaped groove, and a handle bar aligned with openings of the S-shaped grooves.

A ninth alternative boss 558, shown in FIG. 22, includes a recessed wall 560, a first transition wall 562, a second transition wall 564, a top transition wall 566, and a bottom transition wall 568 that are similar to walls 462, 464, 466, 468, 470, respectively, of boss 460. Boss 558 has a cavity 570 bounded by walls 560, 562, 564, 566, 568 thereof First and second transition walls 562, 564 are each formed to include an S-shaped groove 572. An alternative side handle bar 574 includes a first end 576, a second end 578 spaced apart from first end 576, and a gripping portion 580 between first and second ends 576, 578. Side handle bar 574 is similar to side handle bar 544 except that side handle bar 574 is a solid bar whereas side handle bar 544 is a tubular bar. First and second ends 576, 578 of side handle bar 574 are received in S-shaped grooves 572 of respective first and second transition walls 562, 564 and gripping portion 580 of side handle bar 574 is positioned to lie outside grooves 572 and inside cavity 570. Main portion 320 of side wall 314 is formed to include a pair of openings 582 which respective first and second ends 576, 578 of side handle bar 574 pass through during insertion into grooves 572.

First and second transition walls 562, 564 each include an edge 584 that defines the respective S-shaped groove 542 as shown in FIG. 22. Each edge 584 is formed to include a detent 586 that engages respective first and second ends 576, 578 of side handle bar 574 to hold side handle bar 574 in place relative to boss 558. Detents 586 are sized to allow ends 576, 578 of side handle bar 574 to snap into place during the installation of side handle bar 574. When side handle bar 574 is used to lift casket 310, ends 576, 578 of side handle bar 574 engage respective top curved portions of edges 584 and when casket 310 is at rest on a supporting structure (not shown), ends 576, 578 of side handle bar 574 are supported on a ledge portion 588 of respective edges 584. In addition, detents 586 limit the ease with which side handle bar 574 can be pulled transversely away from recessed wall 560.

Figure 23:
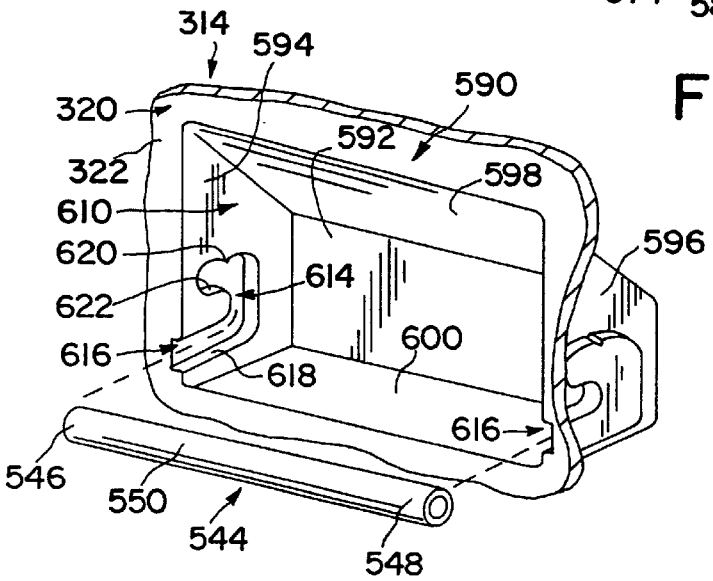
FIG. 23 is a perspective view of a tenth alternative embodiment boss showing the boss defining a recessed cavity in a casket side wall, transition walls of the boss each being formed to include a C-shaped groove, and a handle bar aligned with openings of the C-shaped grooves.

A tenth alternative boss 590, shown in FIG. 23, includes a recessed wall 592, a first transition wall 594, a second transition wall 596, a top transition wall 598, and a bottom transition wall 600 that are similar to walls 462, 464, 466, 468, 470, respectively, of boss 460. Boss 590 has a cavity 610 bounded by walls 592, 594, 596, 598, 600 thereof First and second transition walls 594, 596 are each formed to include a C-shaped groove 614. First and second ends 546, 548 of side handle bar 544 are received in C-shaped grooves 614 of respective first and second transition walls 594, 596 and gripping portion 550 of side handle bar 544 is positioned to lie outside grooves 614 and inside cavity 610. Main portion 320 of side wall 314 is formed to include a pair of openings 616 which respective first and second ends 546, 548 of side handle bar 544 pass through during insertion into grooves 614.

First and second transition walls 594, 598 each include an edge 618 that defines the respective C-shaped groove 614 as shown in FIG. 23. Each edge 618 is formed to include a detent 620 that engages respective first and second ends 546, 548 of side handle bar 544 to hold side handle bar 544 in place relative to boss 590. Detents 620 are sized to allow ends 546, 548 of side handle bar 544 to snap into place during the installation of side handle bar 544. When side handle bar 544 is used to lift casket 310, ends 546, 548 of side handle bar 544 engage respective top curved portions of edges 618 and when casket 310 is at rest on a supporting structure (not shown), ends 546, 548 of side handle bar 544 are supported on a ledge portion 622 of respective edges 618. In addition, detents 620 limit the ease with which side handle bar 544 can be pushed transversely toward recessed wall 592.

Although grooves 540, 572, 614 of bosses 526, 558, 590 are L-shaped, S-shaped, and C-shaped, respectively, it is within the scope of the invention as presently perceived for the internal bosses of casket 310 to be provided with grooves having other shapes. For example, grooves extending transversely, grooves extending vertically, or straight grooves that are angled could be provided. It is within the scope of the invention as presently perceived for main portion 322 of side wall 314 associated with any of bosses 526, 558, 590 to be formed decoratively so as to camouflage respective openings 552, 582, 616. It is also within the scope of the invention as presently perceived for casket 310 to include plugs that fill respective openings 552, 582, 616 and a portion of the associated grooves 540, 572, 614.

In addition, although bosses 460, 488, 526, 558, 590 are shown in FIGS. 19–23, respectively, as being somewhat box-shaped, it is within the scope of the invention as presently perceived for bosses 460, 488, 526, 558, 590 to have any one of a number of other shapes. For example, one or more of the walls of bosses 460, 488, 526, 558, 590 could be blended together more smoothly so that the point at which boss material is considered to be part of any one of the walls of respective bosses 460, 488, 526, 558, 590 is less discernable. For example, bosses 460, 488, 526, 558, 590 can be substantially bowl-shaped and can be embossed, debossed, painted, or otherwise modified to provide bosses 460, 488, 526, 558, 590 with a decorative appearance.

Furthermore, although side handle bars 476, 516, 544, 574 are shown has being straight fixed bars, it is within the scope of the invention as presently perceived for swing-type side handle bars to be used in conjunction with bosses 460, 488, 526, 558, 590. In such embodiments, the swing-type side handle bar includes a grip portion, similar to bars 233 associated with casket 210 shown in FIGS. 7 and 8, that is swingable between a non-operative position inside respective cavities 472, 500, 540, 570, 610 of bosses 460, 488, 526, 558, 590 and a use position outside respective cavities 472, 500, 540, 570, 610.

Figure 24:
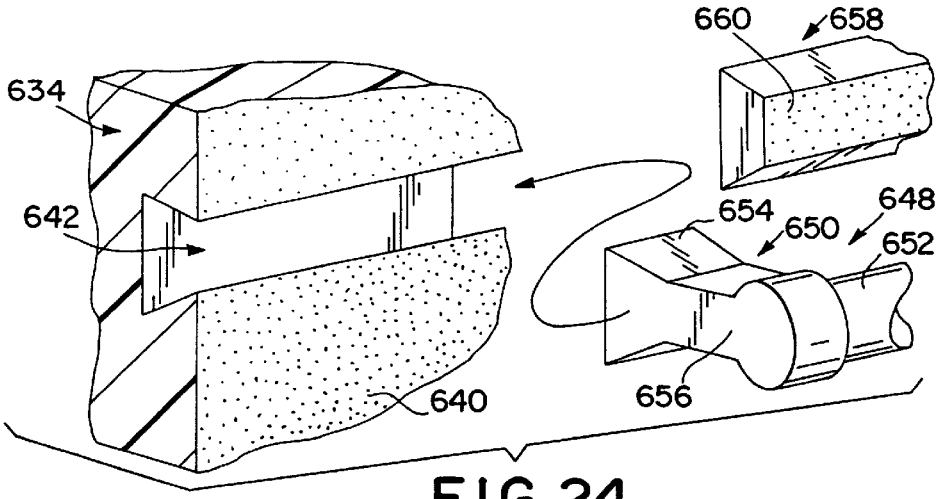
FIG. 24 is a perspective view of an eleventh alternative embodiment boss showing a casket side wall being formed to include a female dove-tail channel that defines the boss, a handle bar having a male dove-tail arm that slides into the dove-tail channel to couple the handle bar to the casket side wall, and a male dove-tail filler plug that slides into the dove-tail channel adjacent to the handle bar.
Figure 25:
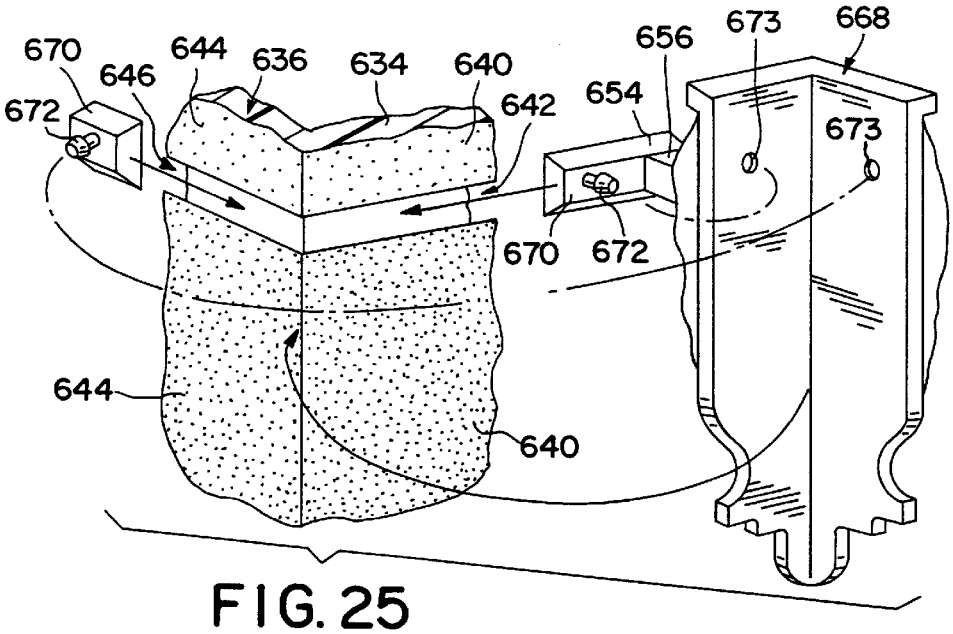
FIG. 25 is a perspective view of a casket having female dove-tail channels formed in a side wall and an end wall thereof showing a male dove-tail mounting block that slides into the dove-tail channel of the end wall, a male dove-tail mounting block appended to a male dove-tail arm, and a corner molding piece that attaches to posts extending from respective mounting blocks.
Figure 27:
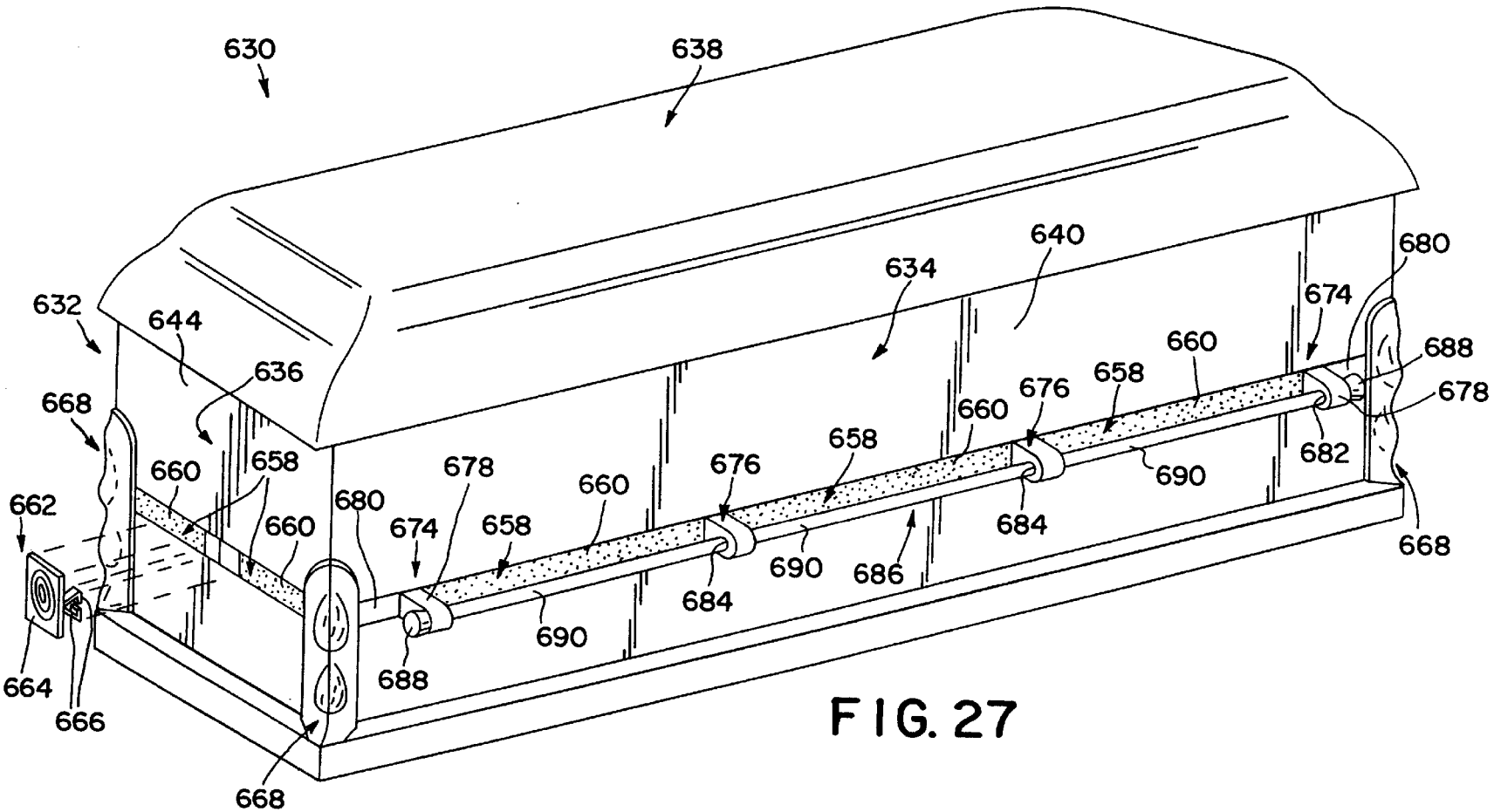
FIG. 27 is a perspective view of a casket having female dove-tail channels formed in side walls and end walls thereof showing a plurality of arms extending outwardly from the channels of the side walls, a handle bar coupled to the handle bar arms, a plurality of male dove-tail filler plugs received in the female dove-tail channels formed in the side and end walls, and a snap-in piece of decorative molding that mounts to the end wall of the casket.

A fourth embodiment casket 630 includes a casket shell 632 having side walls 634 and end walls 636 as shown in FIG. 27. Casket 630 includes a lid 638 that covers an interior region of casket shell 632 when in a closed position. Lid 638 is movable to an opened position to display the contents of casket shell 632. Side walls 634 each include an outwardly facing surface 640 in which a debossed channel 642 is formed as shown in FIGS. 24 and 25. In addition end walls 636 each include an outwardly facing surface 644 in which a debossed channel 646 is formed as shown in FIG. 25.

Channels 642 of side walls 634 and channels 646 of end walls 636 receive portions of various casket components as shown in FIGS. 24, 25, 27, and 28. In preferred embodiments, channels 642, 646 have a female dove-tail shape cross section and the portions of the components received in channels 642, 646 have a male dove-tail shape cross section. Side and end walls 634, 636 could be provided with channels having cross-sectional shapes other than female dove-tail, as long as the portions of the casket components received in the alternatively female-shaped channels are correspondingly male-shaped.

In one embodiment of casket 630, a set of handles 648, each having one or more arms 650 and a grip bar 652 are coupled to side walls 634 as shown in FIG. 24. Arms 650 of each handle 648 include a male dove-tail shaped portion 654 and an outwardly-extending portion 656. Portion 654 of each handle 648 is received in one of channels 642 and grip bar 652 of each handle 648 is coupled to portion 656 of respective arms 650. The dove-tail shape of channels 642 and portions 654 of arms 650 permits longitudinal sliding movement of handles 648 relative to side walls 634 during the assembly of casket 630 but prevents handles 648 from being pulled transversely away from side walls 634.

Figure 28:
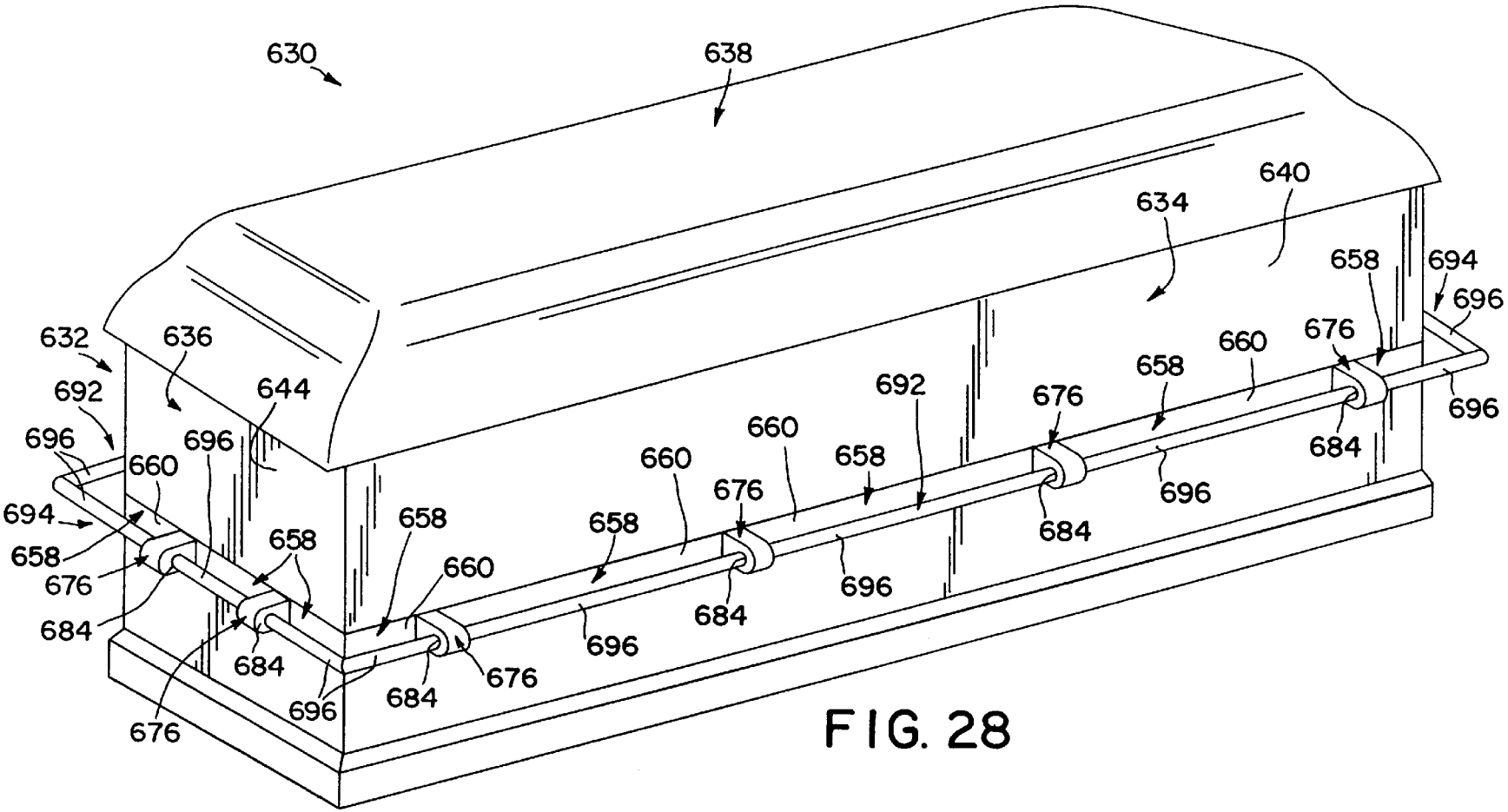
FIG. 28 is a perspective view of a casket having female dove-tail channels formed in side walls and end walls thereof showing a plurality of male dove-tail arms extending outwardly from the channels of the side and end walls, a side handle bar coupled to the arms on each side of the casket, an end bar coupled to the arms on each end of the casket, and the side handle bars cooperating with the end handle bars to surround a casket shell of the casket.

Casket 630 includes one or more filler plugs 658 that are received in channels 642, 646 between the other components having portions received in channels 642, 646 as shown in FIGS. 24, 27, and 28. Some filler plugs 658 are provided with outer surfaces 660 that are flush with outwardly facing surfaces 640, 644 of respective side and end walls 634, 636 and other filler plugs (not shown) are provided with outer surfaces that are decorative and extend outwardly beyond outwardly facing surfaces 640, 644 of respective side and end walls 634, 636. Filler plugs 658 each have a male dove-tail shape cross section and slide into place within respective channels 642, 646.

In some embodiments, casket 630 includes one or more snap-in molding pieces 662 as shown in FIG. 27. Each snap-in molding piece 662 includes a decorative plate 664 and one or more resilient fingers 666 attached to plate 664. Snap-in molding pieces 662 are mounted to side and end walls 632, 634 by pushing plate 664 toward respective side and end walls 632, 634 so that resilient fingers 666 flex and snap into respective channels 642, 646. Receipt of resilient fingers 666 in either of channels 642, 646 secures the respective molding piece 662 to casket shell 632.

Some embodiments of casket 630 include corner molding pieces 668 at each of the corners of casket shell 632 as shown in FIGS. 25 and 27. Mounting blocks 670 are received in channels 642, 646 and each corner molding piece 668 couples to respective mounting blocks 670. Mounting blocks 670 may be either single separate blocks, as shown in FIG. 25 with respect to mounting block 670 received in channel 646 of end wall 636, or formed integrally with another component of casket 630. For example, some mounting blocks 670 are integrally appended to male dove-tail shaped portions 654 of respective handles 648 as shown in FIG. 25. Illustrative mounting blocks 670 each include a mounting peg 672 and corner molding pieces 668 each include apertures 673 in which mounting pegs 672 are received. Receipt of mounting pegs 672 in apertures 673 secures the respective corner molding piece 670 to casket shell 632. Alternative mounting blocks (not shown) can include other types of elements, such as snaps, clips, brackets, resilient fingers, hooks, and other types of fasteners of all sorts, that allow corner molding pieces 668 to be coupled to casket shell 632.

As is evident from the above description, a variety of casket components can be coupled to casket 630 by insertion of all or just a portion of the respective casket component into channels 642, 646 formed in side and end walls 634, 636. For example, one embodiment of casket 630, shown in FIG. 27, includes three elongated filler plugs 658 in channels 642 and two short filler plugs 658 in channel 646. One snap-in molding piece 662 is mounted to each end wall 636 so that the resilient fingers 666 of respective molding pieces 662 are positioned to lie in channels 646 between the short filler plugs 658.

Included in casket 630, shown in FIG. 27, along each side thereof are a pair of first arms 674 and a pair of second arms 676 between first arms 674. Each arm 674 includes an outwardly-extending portion 678, a mounting block (not shown) that is similar to mounting blocks 670, and a connecting portion 680 that interconnects portion 678 with the respective mounting block. Corner molding pieces 668 of casket 630, shown in FIG. 27, are coupled to the mounting blocks of respective arms 674 and to mounting blocks 670 received in channels 646. Outwardly-extending portions 678 of arms 674 are each formed to include an aperture 682 and arms 676 are each formed to include an aperture 684. Casket 630, shown in FIG. 27, includes a pair of elongated side handle bars 686 that extend through apertures 682, 684 formed in respective arms 674, 676. Each side handle bar 686 includes first and second ends (not shown) to which end caps 688 mount. End caps 688 engage respective outwardly-extending portions 678 of arms 674 to constrain respective side handle bars 686 from moving longitudinally relative to casket shell 632. Side handle bars 686 each include gripping portions 690 that are positioned to lie between arms 674, 676 and that are gripped to carry casket 630.

Another embodiment of casket 630, shown in FIG. 28, includes three elongated filler plugs 658 and two short filler plugs 658 in each channel 642 formed in side walls 634. In addition, casket 630, shown in FIG. 28, includes three short filler plugs 658 in each channel 646 formed in end wall 636. Arms 676 are positioned to lie between the ends of respective filler plugs 658 with the exception of the ends of the short filler plugs 658 at the corners of casket shell 632 which are adjacent to one another. Casket 630, shown in FIG. 28, includes a pair of side handle bars 692 extending through apertures 684 of arms 676 coupled to side walls 634 and a pair of end handle bars 694 extending through apertures 684 of arms 676 coupled to end walls 636. The ends of side handle bars 692 are coupled to the ends of end handle bars 694 so that casket shell 632 is surrounded by handle bars 692, 694. Side and end handle bars 692, 694 each include gripping portions 696 on either side of each of the respective arms 676. Gripping portions 696 are gripped to carry casket 630.

Figure 26:
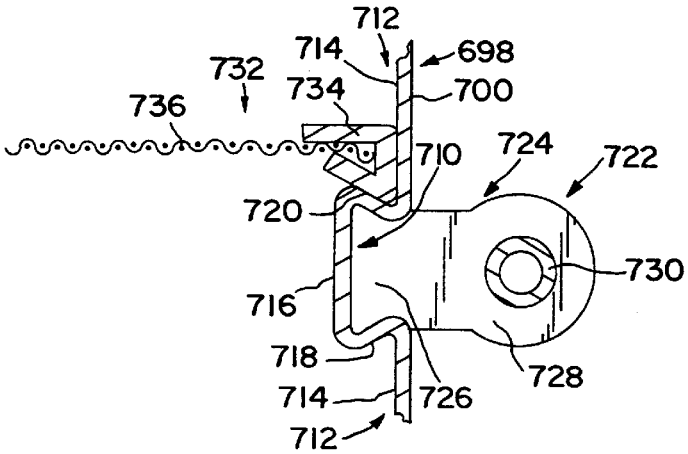
FIG. 26 is a sectional view of a twelfth alternative embodiment boss showing a metal sheet of a casket side wall being formed to include a female dove-tail channel that defines the boss, a handle having a male dove-tail arm that slides into the dove-tail channel to couple the handle bar to the casket side wall, and a mattress frame that engages an upwardly facing ledge surface of the portion of the metal sheet in which the female dove-tail channel is formed.

Side and end walls 634, 636 of casket 630 are made of a material, such as wood, metal, or a plastics material, having sufficient thickness to allow channels 642, 646 to be formed therein without interrupting flat inner surfaces of the material. A cross section of an alternative embodiment side wall 698 which is part of a casket (not shown) having side walls and end walls made out of a thin sheet of material, such as metal or a plastics material, is shown in FIG. 26. Side wall 698 includes an outwardly facing surface 700 having a debossed channel 710 formed therein. Illustrative channel 710 has a female dove-tail shape cross section, but channels of other shapes could be provided as well. A side handle 722 includes an arm 724 having a male dove-tail shaped portion 726 received in channel 710 and an outwardly-extending portion 728 extending from portion 724 past channel 710 and away from side wall 698. Side handle 722 also includes a grip bar 730 coupled to portion 726.

Side wall 698 includes an inner surface 712 as shown in FIG. 26. Inner surface 712 includes two main vertical surfaces 714 separated by channel 710, a vertical surface 716 that is inwardly offset from main vertical surfaces 714, a substantially downwardly facing surface 716, and a substantially upwardly facing ledge surface 718. Formation of female dove-tail shaped channel 710 in side wall 698 causes surfaces 716, 718, 720 to have a male dove-tail shape cross section in the interior region of the casket associated with wall 698. A mattress support 732 is supported by ledge surface 718 in interior region of the casket associated with wall 698. Mattress support 732 includes a mattress frame 734 and a mattress supporting element, such as a wire mesh screen 736, coupled to frame 734. Ledge surface 718 and mattress support 732 cooperate to support a mattress (not shown) in spaced apart relation with a bottom wall (not shown) of the casket associated with side wall 698. It is within the scope of the invention as presently perceived for other casket components to be supported by ledge surface 720 in the interior region of the casket associated with side wall 698 in addition to or instead of mattress support 732.

A cross section of a further alternative embodiment side wall 738 which is part of a casket (not shown) having side walls and end walls made out of a thin sheet of material, such as metal or a plastics material, is shown in FIGS. 29 and 30. Side wall 738 includes an outwardly facing surface 740 having an embossed rail 742 formed therein. Illustrative rail 742 has a male dove-tail shape cross section, but rails of other shapes could be provided as well. A swing handle assembly 744 includes an arm 746 having a female dove-tail shaped portion 748 that slides onto rail 742 to mount swing handle assembly 744 to the casket associated with side wall 738. Other components (not shown), such as decorative pieces and mounting plugs for attaching corner molding, can be adapted to mount onto rail 742.

Arm 746 includes an outwardly-extending portion 750 extending from portion 748 away from side wall 738 and swing handle assembly 744 includes a swing arm 752 pivotably coupled to portion 750 of arm 746 as shown in FIGS. 29 and 30. Swing handle assembly 744 also includes a grip bar 754 coupled to a lower portion 756 of swing arm 752. Swing arm 752 includes an upper portion 758 having a stop surface 760 and arm 746 includes an upwardly facing surface 762 beneath stop surface 760. Grip bar 754 is swingable between a non-operative position in which swing arm 752 is substantially vertically oriented as shown in FIG. 29 and a use position in which swing arm 752 is pivoted to an inclined orientation and grip bar 754 is moved away from side wall 738 as shown in FIG. 30. As grip bar 754 is moved between the non-operative and use positions, swing arm 752 pivots about an axis 764 relative to arm 746. When grip bar 754 reaches the use position, stop surface 760 engages surface 762 of arm 746 to prevent grip bar 754 from moving past the use position.

Swing handle assembly 744 includes a cam latch 766 as shown in FIGS. 29 and 30. Cam latch 766 is coupled to arm 746 for pivoting movement about an axis 768 beneath rail 742. A portion of rail 742 has a substantially downwardly facing surface 770 and cam latch 766 includes a rail-engaging surface 772. Cam latch 766 also includes a curved wall-engaging surface 774. Cam latch 766 is movable about axis 768 between a releasing position, shown in FIG. 29, in which swing handle assembly 744 is permitted to slide on rail 742 relative to side wall 738 and a locking position, shown in FIG. 30, in which swing handle assembly 744 is prevented from sliding on rail 742 relative to side wall 738. When cam latch 766 is in the releasing position, rail-engaging surface 772 is spaced apart from rail 742 and wall-engaging surface 774 is spaced apart from side wall 738. When cam latch 766 is in the locking position, rail-engaging surface 772 engages surface 770 of rail 742 and wall-engaging surface 774 engages outwardly facing surface 740 of side wall 738. The shape of surfaces 772, 774 of cam latch 766 and the shape of rail 742 causes cam latch 766 to be wedged into the locking position in an over-center manner.

Thus, the integral hardware bosses of the present invention can be external bosses, such as bosses 324, 348, 372, 390, 422, 442, that protrude away from the associated casket shell or internal bosses, such as bosses 460, 488, 526, 558, 590, that are recessed into the associated casket shell. In addition, the integral hardware bosses of the present invention can be rails, such as rail 742, or channels, such as channels 642, 646, 710, formed in the respective walls of the associated casket shell. In each case, handles for carrying the casket are coupled to the respective hardware bosses that are formed integrally and contiguously with the walls of the associated casket shell.

Although the invention has been described in detail with reference to preferred embodiments, additional variations and modifications exist within the scope and spirit of the invention as described and defined in the following claims.

What is claimed is:

1. A casket comprising a casket shell including a side wall having an outwardly facing side surface and an external hardware boss formed integrally and contiguously with the side wall, the external hardware boss protruding outwardly therefrom, the external hardware boss including a protruded wall offset outwardly from the side wall, a first transition wall integrally connecting the side wall and the protruded wall, and a second transition wall integrally connecting the side wall and the protruded wall, the side wall having a thickness and at least one of the protruded wall and the first and second transition walls having a thickness that is substantially equivalent to the thickness of the side wall, the first and second transition walls each being formed to include a handle-receiving void, and a handle extending through the handle-receiving voids of the first and second transition walls, the handle having portions extending beyond the first and second transition walls that can be gripped for carrying the casket.

2. The casket of claim 1, wherein the handle-receiving void formed in the first transition wall is an aperture extending through the first transition wall and the handle-receiving void formed in the second transition wall is an aperture extending through the second transition wall.

3. The casket of claim 2, wherein the casket shell is made of a plastics material, the external hardware boss is a substantially solid piece of plastics material between the first and second transition walls, and the external hardware boss has a space between the apertures formed in the first and second transition walls that is absent of plastics material to provide a bore extending through the external hardware boss.

4. A casket comprising a casket shell including a side wall having an outwardly facing side surface and a plurality of external hardware bosses formed integrally and contiguously with the side wall, each external hardware boss being generally hollow and formed to define an interior region that is at least partially bounded by a respective protruded wall offset outwardly from the side wall, a respective first transition wall integrally connecting the side wall and respective protruded wall, and a respective second transition wall spaced apart from the respective first transition wall and integrally connecting the side wall and respective protruded wall, each of the first and second transition walls being formed to include a handle-receiving void, and an elongated handle bar extending through all of the handle-receiving voids formed in the first and second transition walls, the handle bar including gripping portions between the hardware bosses.

5. The casket of claim 4, wherein each handle-receiving void is an aperture extending through the respective first and second transition wall.

6. The casket of claim 4, wherein the elongated handle bar includes a first end extending beyond the first transition wall of one of the external hardware bosses, a second end extending beyond the second transition wall of another of the external hardware bosses, a first end cap coupled to the first end, and a second end cap coupled to the second end.

7. The casket of claim 6, wherein the first end cap abuts the first transition wall of one of the external hardware bosses to prevent movement of the handle bar in a first direction and the second end cap abuts the second transition wall of another of the external hardware bosses to prevent movement of the handle bar in a second direction.

8. The casket of claim 4, wherein each external hardware boss further includes a top transition wall integrally connecting together the side wall of the casket shell, the protruded wall of the respective external hardware boss, and the respective first and second transition walls and a bottom transition wall integrally connecting together the side wall of the casket shell, the protruded wall of the respective external hardware boss, and the respective first and second transition walls.

9. The casket of claim 8, wherein the handle bar includes hidden portions that are positioned to lie in the respective interior regions of each external hardware boss between the respective first, second, top, and bottom transition walls.

10. A casket comprising a casket shell including a side wall having an outwardly facing side surface, a protruded wall offset outwardly from the side wall, a first transition wall integrally connecting the side wall and protruded wall, and a second transition wall integrally connecting the side wall and the protruded wall, the first and second transition walls cooperating with the protruded wall to define a protrusion in the side wall to provide the casket with an external hardware boss, the first and second transition walls each being formed to include a handle-receiving void, and a handle extending through the handle-receiving voids of the first and second transition walls, the handle having portions extending beyond the first and second transition walls that can be gripped for carrying the casket, the handle-receiving void formed in the first transition wall being an aperture extending through the first transition wall, the handle-receiving void formed in the second transition wall being an aperture extending through the second transition wall, the casket shell being made of a plastics material, the external hardware boss being a substantially solid piece of plastics material between the first and second transition walls, and the external hardware boss having a space between the apertures formed in the first and second transition walls that is absent of plastics material to provide a bore extending through the external hardware boss.

11. A casket comprising a casket shell including a side wall having an outwardly facing side surface and a plurality of external hardware bosses integrally and contiguously appended to the side wall, each external hardware boss including a protruded wall offset outwardly from the side wall, a first transition wall integrally connecting the side wall and respective protruded wall, and a second transition wall spaced apart from the respective first transition wall and integrally connecting the side wall and respective protruded wall, each of the first and second transition walls being formed to include a handle-receiving void, and an elongated handle bar extending through all of the handle-receiving voids formed in the first and second transition walls, the handle bar including gripping portions between the hardware bosses, each external hardware boss including a top transition wall integrally connecting together the side wall of the casket shell, the protruded wall of the respective external hardware boss, and the respective first and second transition walls and a bottom transition wall integrally connecting together the side wall of the casket shell, the protruded wall of the respective external hardware boss, and the respective first and second transition walls, and each external hardware boss being substantially hollow between the respective first, second, top, and bottom transition walls.

12. A casket comprising a casket shell including a side wall having an outwardly facing side surface and a hardware boss formed integrally and contiguously with the side wall and protruding outwardly therefrom, the side wall having a first thickness and the hardware boss having a plurality of wall portions, at least one of the plurality of wall portions having a thickness substantially equivalent to the first thickness, the hardware boss being formed to include a handle-receiving void, and a handle including a first portion received in the handle-receiving void, the handle including a second portion extending from the first portion, the second portion of the handle being grippable to carry the casket.

13. The casket of claim 12, wherein the hardware boss is generally hollow and has an interior region bounded at least partially by the plurality of wall portions.

14. The casket of claim 13, wherein the handle-receiving void is in fluid communication with the interior region.

15. The casket of claim 13, wherein the handle-receiving void is separated from the interior region by at least one of the wall portions.

16. The casket of claim 12, wherein the side wall and hardware boss are made from a sheet of material.

17. The casket of claim 16, wherein the sheet of material is a metal material.

18. The casket of claim 16, wherein the sheet of material is a plastics material.

19. A casket comprising a casket shell including a side wall having an outwardly facing side surface and a hardware boss formed integrally and contiguously with the side wall and protruding outwardly therefrom, the hardware boss including a plurality of wall portions configured to define a generally hollow interior region, the hardware boss being formed to include a handle-receiving void, and a handle including a first portion received in the handle-receiving void, the handle including a second portion extending from the first portion, the second portion of the handle being grippable to carry the casket.

20. The casket of claim 19, wherein the handle-receiving void is in fluid communication with the interior region.

21. The casket of claim 19, wherein the handle-receiving void is separated from the interior region by at least one of the wall portions.

22. The casket of claim 19, wherein the side wall and hardware boss are made from a sheet of material.

23. The casket of claim 22, wherein the sheet of material is a metal material.

24. The casket of claim 22, wherein the sheet of material is a plastics material.

* * * * *